US009309851B2

(12) United States Patent
Oomura et al.

(10) Patent No.: US 9,309,851 B2
(45) Date of Patent: Apr. 12, 2016

(54) FUEL INJECTION VALVE

(71) Applicant: DENSO CORPORATION, Kariya, Aichi-pref. (JP)

(72) Inventors: Hidekazu Oomura, Hekinan (JP); Masanori Miyagawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 23 days.

(21) Appl. No.: 14/198,829

(22) Filed: Mar. 6, 2014

(65) Prior Publication Data

US 2014/0252137 A1 Sep. 11, 2014

(30) Foreign Application Priority Data

Mar. 6, 2013 (JP) ..... 2013-44504
Mar. 6, 2013 (JP) ..... 2013-44505

(51) Int. Cl.
*B05B 1/30* (2006.01)
*F02M 61/18* (2006.01)

(52) U.S. Cl.
CPC ..... *F02M 61/1806* (2013.01)

(58) Field of Classification Search
CPC F02M 61/186; F02M 61/1853; F02M 61/162
USPC ..... 239/533.12, 533.14, 533.2, 585.5, 584
See application file for complete search history.

(56) References Cited

U.S. PATENT DOCUMENTS 5,875,972 A 3/1999 Ren et al.
5,931,391 A 8/1999 Tani et al.
6,089,476 A * 7/2000 Sugimoto et al. ..... 239/596
6,974,095 B2 * 12/2005 Harata et al. ..... 239/596
7,032,566 B2 * 4/2006 Cavanagh et al. ..... 123/299
7,100,848 B2 * 9/2006 Kobayashi et al. ..... 239/596
2004/0164187 A1 8/2004 Kihara et al.
2009/0065609 A1 3/2009 Suzuki
2014/0191065 A1 7/2014 Suzuki

FOREIGN PATENT DOCUMENTS

JP 8-277763 10/1996
JP 2000-320433 11/2000

(Continued)

OTHER PUBLICATIONS

Office Action (2 pages), dated Mar. 17, 2015, issued in corresponding Japanese Application No. 2013-044504 and English translation (3 pages).

(Continued)

*Primary Examiner* — Davis Hwu
(74) *Attorney, Agent, or Firm* — Nixon & Vanderhye P.C.

(57) ABSTRACT

A fuel injection valve for injecting fuel radially includes a valve housing and a valve member. The housing includes fuel nozzle holes arranged in a circumferential direction with a common pitch on a common imaginary circle. Each nozzle hole is inclined toward an outer peripheral side from a fuel inlet to outlet. The nozzle holes have a common shape around their hole axes. The nozzle holes are classified into any of nozzle hole groups. Each group includes at least two of the nozzle holes, which are arranged in a predetermined order with different inclination angles of their hole axes relative to the central axis of the housing. The order of the arrangement of the at least two of the nozzle holes is set at a common order toward one side in the circumferential direction, among the groups.

4 Claims, 18 Drawing Sheets

(56) References Cited

FOREIGN PATENT DOCUMENTS

| | | |
|---|---|---|
| JP | 2000-328983 | 11/2000 |
| JP | 2002-054532 | 2/2002 |
| JP | 2005-139989 | 6/2005 |
| JP | 2005-207274 | 8/2005 |
| JP | 2005-233145 | 9/2005 |
| JP | 2010-180784 | 8/2010 |
| JP | 2012-122441 | 6/2012 |
| WO | WO 2009/055315 | 4/2009 |

OTHER PUBLICATIONS

Office Action (2 pages), dated Mar. 17, 2015, issued in corresponding Japanese Application No. 2013-044505 and English translation (3 pages).

Oct. 6, 2015 Decision of Refusal issued in Japanese Patent Application No. 2013-044504 (with English-language translation).

Sep. 29, 2015 Notification of Reason for Refusal issued in Japanese Patent Application No. 2013-044505 (with English-language translation).

* cited by examiner

FUEL INJECTION VALVE

CROSS REFERENCE TO RELATED APPLICATION

This application is based on Japanese Patent Applications No. 2013-44504 filed on Mar. 6, 2013 and No. 2013-44505 filed on Mar. 6, 2013, the disclosures of which are incorporated herein by reference.

TECHNICAL FIELD

The present disclosure relates to a fuel injection valve which injects fuel radially in an internal combustion engine.

BACKGROUND

Conventionally, there is known a fuel injection valve having fuel nozzle holes, which are inclined further on an outer peripheral side from a fuel inlet toward a fuel outlet. The fuel nozzle holes are formed and arranged at a valve housing in its circumferential direction. This fuel injection valve opens or closes the fuel nozzle holes through reciprocation movement of a valve member accommodated in the valve housing to perform or stop fuel injection through the fuel nozzle holes.

In a fuel injection valve described in, for example, JP-A-H08-277763, fuel nozzle holes arranged with a common pitch on a common imaginary circle have a common shape around hole axes which are inclined relative to the central axis of a valve housing on the same longitudinal section. As a result of such a configuration, facility in formation of the fuel nozzle holes is increased, and atomization of a spray of fuel injected through each of these fuel nozzle holes is achieved.

In the fuel injection valve of JP-A-H08-277763, inclination angles of the hole axes relative to the central axis are common for each fuel nozzle hole. In this case, for example, when diameter of the fuel nozzle hole is increased or the number of fuel nozzle holes is increased, the pitch between the fuel nozzle holes which are adjacent in a circumferential direction of the valve housing is reduced, and a distance between sprays of fuel injected through these fuel nozzle holes is decreased. As a result, particle diameter of the spray is made coarse because of collision and interference between the sprays of fuel through the adjacent fuel nozzle holes. This coarsening of particle diameter of the spray increases a time required for fuel vaporization to make it difficult to form air-fuel mixture, so that performance of an internal combustion engine may be reduced.

In the fuel injection valve in, for example, JP-A-H08-277763, a pitch circle passing through all the fuel nozzle holes is defined. Based on this definition, the sprays of fuel injected through the adjacent fuel nozzle holes on the pitch circle easily collide and interfere with each other, so that the coarsening of particle diameter of the spray is caused. Accordingly, the atomization of the fuel spray becomes difficult.

For this reason, in a fuel injection valve described in JP-A-H11-070347, an outer imaginary circle passing through outer nozzle holes serving as fuel nozzle holes, and a inner imaginary circle passing through inner nozzle holes serving as fuel nozzle holes radially inward of the outer imaginary circle, are concentrically defined. Based on this definition, the outer nozzle holes and inner nozzle holes are arranged alternately in a circumferential direction of a valve housing so as to be located adjacent to each other between the outer imaginary circle and the inner imaginary circle. Sprays of fuel injected through the outer nozzle holes and the inner nozzle holes which are adjacent as described above do not easily collide and interfere with each other. As a result, the coarsening of particle diameter of the spray can be limited, and the atomization of the fuel spray is thereby made possible.

However, in the fuel injection valve of JP-A-H11-070347, due to a large radial distance between the outer imaginary circle and the inner imaginary circle, attracting force because of the Coanda effect becomes small between the sprays of fuel injected through the outer nozzle holes and the inner nozzle holes which are adjacent to each other. Consequently, it becomes difficult to control penetration (penetrating force) of the fuel spray.

Moreover, in the fuel injection valve in JP-A-H11-070347, because the radial distance between the outer imaginary circle and the inner imaginary circle is large, there is caused a great difference in a fuel flow on an upstream side of a fuel inlet between the outer nozzle holes and the inner nozzle holes. Accordingly, there is caused a great difference also in particle diameter of the sprays of fuel injected through the outer nozzle holes and the inner nozzle holes, which prevents the atomization of the fuel spray.

SUMMARY

The present disclosure addresses at least one of the above issues.

According to the present disclosure, there is provided a fuel injection valve disposed in an internal combustion engine for injecting fuel radially. The valve includes a valve housing and a valve member. The valve housing includes a plurality of fuel nozzle holes arranged in a circumferential direction of the valve housing with a common pitch on a common imaginary circle. Each of the plurality of fuel nozzle holes includes a fuel inlet and a fuel outlet, and is inclined toward an outer peripheral side in a direction from the fuel inlet to the fuel outlet. The plurality of fuel nozzle holes have hole axes, which are inclined relative to a central axis of the valve housing on the same longitudinal section as the central axis, and have a common shape around their hole axes. The plurality of fuel nozzle holes are classified into any of a plurality of nozzle hole groups. Each of the plurality of nozzle hole groups includes at least two of the plurality of fuel nozzle holes. The at least two of the plurality of fuel nozzle holes are arranged in a predetermined order with different inclination angles of their hole axes relative to the central axis. The order of the arrangement of the at least two of the plurality of fuel nozzle holes is set at a common order toward one side in the circumferential direction of the valve housing, among the plurality of nozzle hole groups. The valve member is accommodated and configured to reciprocate in the valve housing to open or close the plurality of fuel nozzle holes, thereby performing or stopping the fuel injection through the plurality of fuel nozzle holes.

According to the present disclosure, there is also provided a fuel injection valve disposed in an internal combustion engine for injecting fuel radially. The valve includes a valve housing and a valve member. The valve housing includes a plurality of fuel nozzle holes arranged in a circumferential direction of the valve housing. Each of the plurality of fuel nozzle holes includes a fuel inlet and a fuel outlet, and is inclined toward an outer peripheral side in a direction from the fuel inlet to the fuel outlet. An outer imaginary circle is defined along the circumferential direction of the valve housing. An inner imaginary circle is defined radially inward of the outer imaginary circle and concentrically with the outer imaginary circle. The plurality of fuel nozzle holes includes a plurality of outer nozzle holes and a plurality of inner nozzle holes, which are arranged alternately in the circumferential direction of the valve housing. An opening edge portion of each of the plurality of outer nozzle holes on its fuel outlet-side includes an innermost peripheral edge portion, which is located on the innermost peripheral side of the valve housing and is positioned on the inner imaginary circle. The outer imaginary circle passes through an outer peripheral side of the innermost peripheral edge portion. An opening edge portion of each of the plurality of inner nozzle holes on its fuel outlet-side includes an outermost peripheral edge portion, which is located on the outermost peripheral side of the valve housing and is positioned on the outer imaginary circle. The inner imaginary circle passes through an inner peripheral side of the outermost peripheral edge portion. The valve member is accommodated and configured to reciprocate in the valve housing to open or close the plurality of fuel nozzle holes, thereby performing or stopping the fuel injection through the plurality of fuel nozzle holes.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
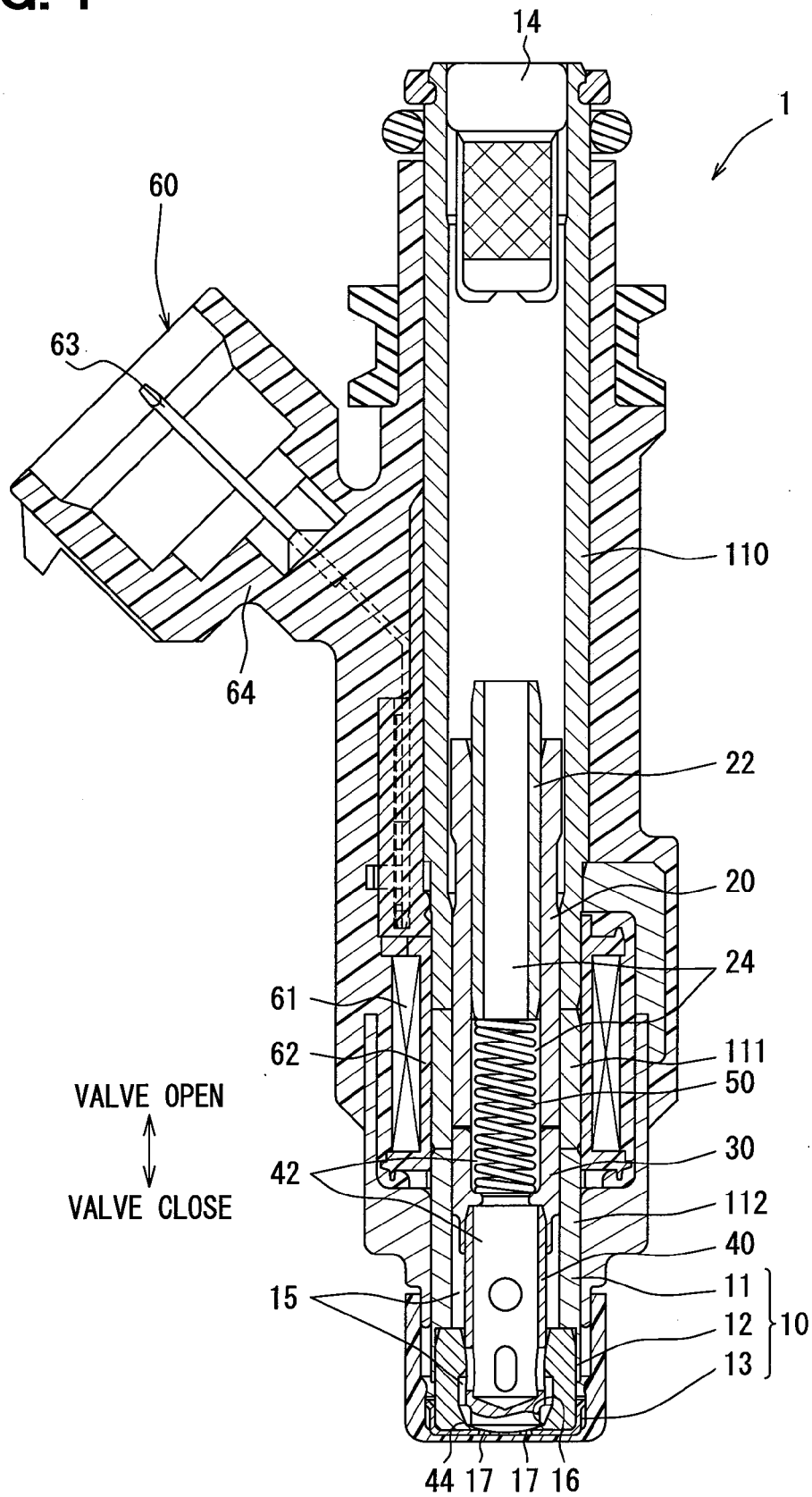
FIG. 1 is a longitudinal sectional view illustrating a fuel injection valve in accordance with a first embodiment.

Embodiments will be described below in reference to the drawings. Using the same reference numeral for corresponding components throughout the embodiments, a repeated description may be omitted. In a case of description of only a part of configuration in each embodiment, a configuration in another embodiment explained ahead of the embodiment can be applied to the other part of the configuration. In addition to a combination of the configurations indicated in the descriptions of the embodiments, the configurations in the embodiments can be partially combined together even without explanation thereof as long as this combination functions.

First Embodiment

FIG. 1 illustrates a fuel injection valve 1 in a first embodiment. The fuel injection valve 1 is disposed in a gasoline engine as an internal combustion engine to inject fuel into an intake port of this gasoline engine. Besides this applied embodiment, the fuel injection valve 1 may also inject fuel into, for example, a combustion chamber of a gasoline engine.

Basic configuration of the fuel injection valve 1 will be described in detail. The fuel injection valve 1 includes a valve housing 10, a fixed core 20, a movable core 30, a valve member 40, a resilient member 50, and a driving unit 60.

The valve housing 10 includes a pipe member 11, a valve body 12, and a nozzle member 13. The cylindrical pipe member 11 includes a first magnetic part 110, a non-magnetic part 111, and a second magnetic part 112 in this order from a valve-open side toward a valve-closed side in an axial direction of the valve 1. The magnetic parts 110, 112 made of a metal magnetic material, and the non-magnetic part 111 made of a metal non-magnetic material are joined together coaxially, for example, through laser welding. By this joining structure, the non-magnetic part 111 cuts off a short circuit of magnetic flux between the first magnetic part 110 and the second magnetic part 112.

The first magnetic part 110 includes a supply inlet 14 to which fuel is supplied from a fuel pump (not shown). The second magnetic part 112 is coaxially and externally fitted and fixed around the valve body 12 made of a cylindrical metal. Together with the pipe member 11, the valve body 12 constitutes a fuel passage 15 so that the fuel guided from an upstream side can flow toward a downstream side. Also, the valve body 12 includes a valve seat 16 exposed to the fuel passage 15. The nozzle member 13 made of a cylindrical metal having a bottom part is coaxially and externally fitted and fixed around the valve body 12 on an opposite side of the valve body 12 from the second magnetic part 112. The nozzle member 13 includes fuel nozzle holes 17 through its bottom part. Each fuel nozzle hole 17 communicates with the fuel passage 15 on a downstream side of the valve seat 16, and opens radially toward the outside (intake port in this embodiment).

The fixed core 20 made of a cylindrical metal magnetic material is coaxially fitted and fixed inward of the first magnetic part 110 and the non-magnetic part 111. An adjusting pipe 22 made of a cylindrical metal is coaxially press-fitted and fixed to the fixed core 20. Together with the adjusting pipe 22, the fixed core 20 constitutes a fixed passage 24 so that the fuel flowing into the valve 1 through the supply inlet 14 on the upstream side can flow out to the downstream side.

The movable core 30 made of a cylindrical metal magnetic material is coaxially accommodated in the non-magnetic part 111 and the second magnetic part 112 to be axially reciprocatable on the valve-closed side of the fixed core 20. The valve member 40 made of a cylindrical metal non-magnetic material having a bottom part is coaxially accommodated in the second magnetic part 112 as well as in the valve body 12, and is fitted and fixed inward of the movable core 30 on its valve-closed side to be axially reciprocatable. Together with the movable core 30, the valve member 40 constitutes a movable passage 42 to guide the fuel flowing out of the fixed passage 24 on the upstream side into the fuel passage 15 on the downstream side.

The valve member 40 includes a seat part 44, which reciprocates on the upstream side of the valve seat 16, at its bottom part on the valve-closed side. The valve member 40 disengages the seat part 44 from the valve seat 16 as a result of its displacement to the valve-open side so as to open each fuel nozzle hole 17 with respect to the fuel passage 15. Consequently, the fuel in the fuel passage 15 is injected radially into the outside (intake port in this embodiment) through the fuel nozzle holes 17. On the other hand, the valve member 40 engages its seat part 44 with the valve seat 16 as a result of its displacement to the valve-closed side so as to close each fuel nozzle hole 17 with respect to the fuel passage 15. Consequently, the fuel injection through the fuel nozzle holes 17 is stopped. As described above, the valve member 40 opens or closes each fuel nozzle hole 17 by its reciprocation movement to be capable of performing or stopping the fuel injection through the fuel nozzle holes 17.

The resilient member 50 is a compression coil spring made of metal, and is coaxially accommodated in the respective passages 24, 42 of the fixed core 20 and the movable core 30. The resilient member 50 is clamped between the adjusting pipe 22 in the fixed core 20 and the movable core 30. By this clamping structure, the resilient member 50 generates resilient restoring force in accordance with its compression between the elements 22, 30 to urge the movable core 30 toward the valve-closed side along with the valve member 40.

The driving unit 60 includes a solenoid coil 61, a spool 62, a terminal 63, and a connector 64. The solenoid coil 61 is formed by winding a metal wiring material around the spool 62 made of a cylindrical resin. The solenoid coil 61 is coaxially and externally fitted and fixed around the magnetic parts 110, 112 and the non-magnetic part 111 through the spool 62. The terminal 63 made of metal is embedded in the connector 64 made of resin to make an electric connection between an external control circuit (not shown) and the internal solenoid coil 61.

Through this electric connection, energization of the solenoid coil 61 can be controlled by the control circuit.

As for valve-opening operation of the above-configured fuel injection valve 1, as a result of the solenoid coil 61 energized by the control circuit being excited, a magnetic flux is guided by the first magnetic part 110, the fixed core 20, the movable core 30, and the second magnetic part 112. Accordingly, magnetic attraction force is produced between the two opposed cores 20, 30 to attract the movable core 30 toward the fixed core 20 on the valve-open side. Whereupon, the movable core 30 is driven to the valve-open side together with the valve member 40 against the urging by the resilient member 50 so as to collide and engage with the fixed core 20. Meanwhile, the valve member 40 disengages the seat part 44 from the valve seat 16, and fuel is thereby injected through each fuel nozzle hole 17.

On the other hand, as for valve-closing operation after such a valve-opening operation, the solenoid coil 61 whose energization is stopped by the control circuit is demagnetized, and the magnetic attraction force between the cores 20, 30 thereby disappears. Whereupon, the movable core 30 is driven to valve-closed side together with the valve member 40 by the resilient member 50, so that the bottom part of the valve member 40 collides and engages with the valve body 12. Accordingly, the valve member 40 engages its seat part 44 with the valve seat 16 thereby to stop the fuel injection through each fuel nozzle hole 17.

A mode of formation of the fuel nozzle hole 17 will be described in detail.

Figure 2:
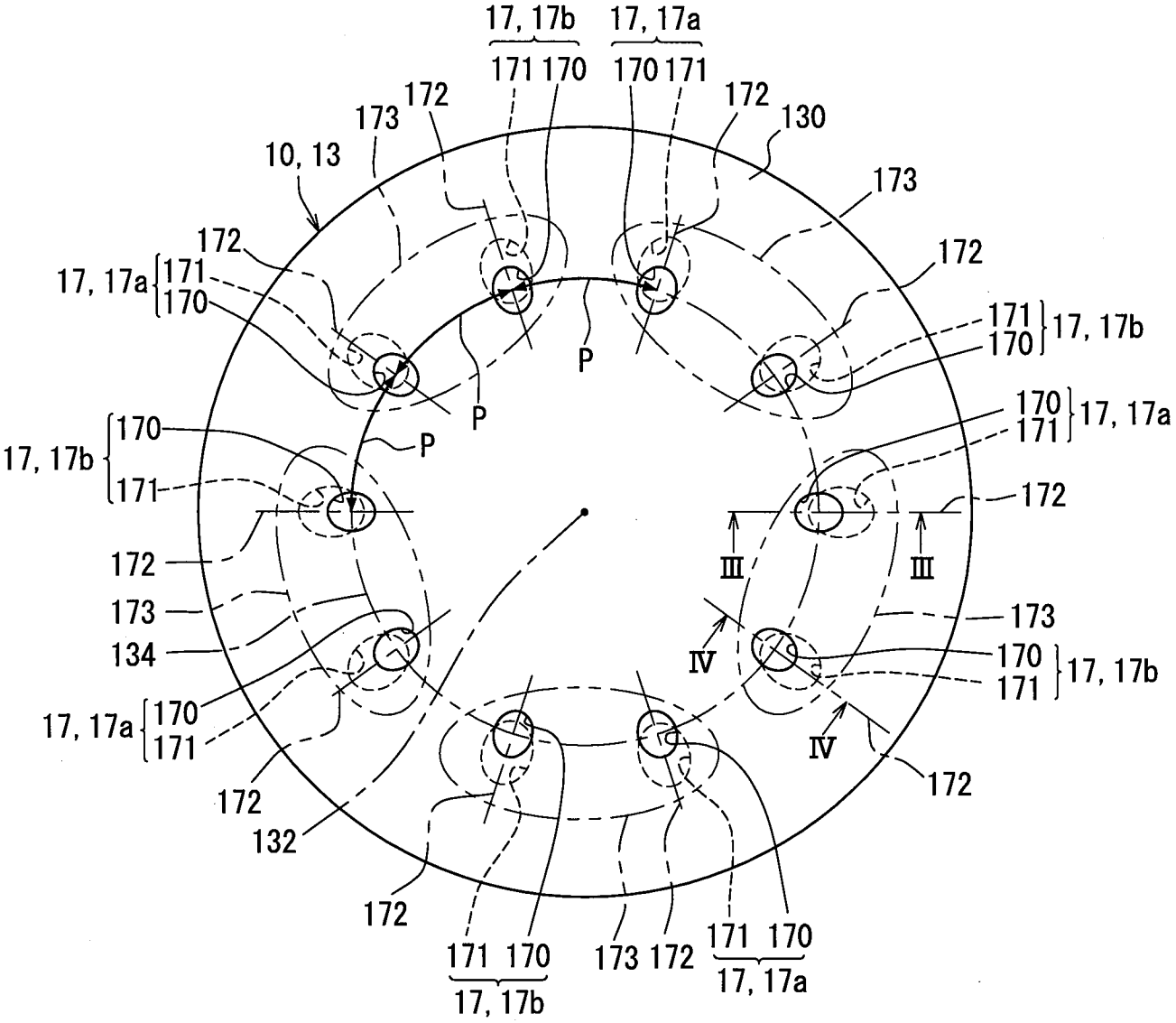
FIG. 2 is an enlarged plan view illustrating fuel nozzle holes of the first embodiment.
Figure 3:
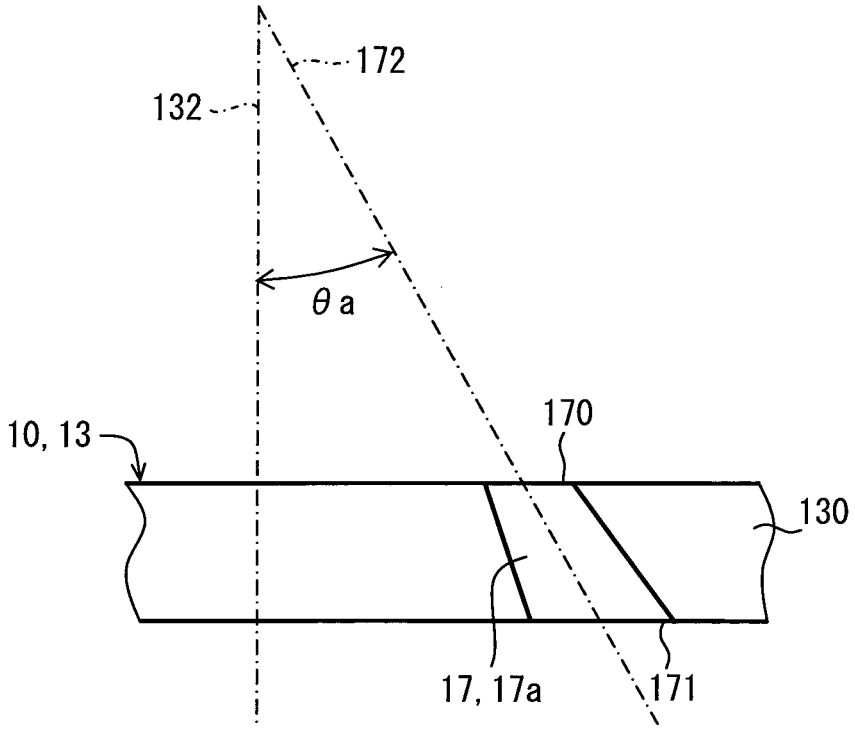
FIG. 3 is an enlarged longitudinal sectional view illustrating the fuel nozzle hole of FIG. 2, and is a sectional view taken along a line III-III in FIG. 2.
Figure 4:
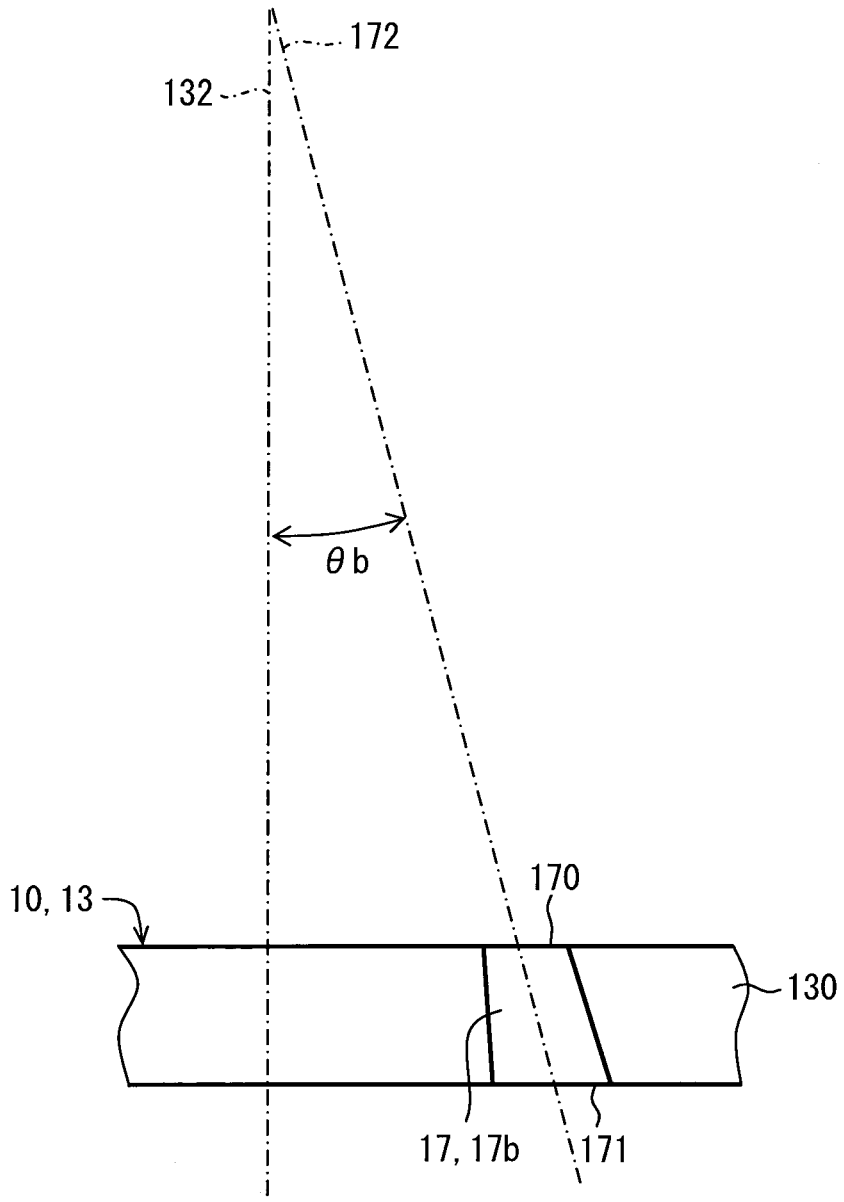
FIG. 4 is an enlarged longitudinal sectional view illustrating the fuel nozzle hole of FIG. 2, and is a sectional view taken along a line IV-IV in FIG. 2.

Through a circular disk-shaped nozzle plate 130, which is the bottom part of the nozzle member 13 of the valve housing 10 illustrated in FIGS. 2 to 4, the fuel nozzle holes 17 are arranged in a circumferential direction around the central axis 132 of this plate 130. The fuel nozzle holes 17 are formed at regular intervals on a common imaginary circle 134 that is concentric with the nozzle plate 130 so as to be arranged with a common pitch P in the circumferential direction.

As a common shape around a hole axis 172, each fuel nozzle hole 17 has a shape of a tapered hole whose diameter is increased further from a fuel inlet 170 toward a fuel outlet 171. Each of the fuel nozzle holes 17 having this common shape is inclined to an outer peripheral side of the nozzle plate 130 further from the fuel inlet 170 toward the fuel outlet 171. The hole axis 172 of each fuel nozzle hole 17 is inclined relative to the central axis 132 on the same longitudinal section (in FIGS. 3 and 4) as the central axis 132. More specifically, the hole axis 172 of each fuel nozzle hole 17 intersects with the central axis 132 at a predetermined inclination angle (hereinafter also referred to simply as an inclination angle).

As indicated by an enclosure by an alternate long and two short dashes line in FIG. 2, the fuel nozzle holes 17 are classified into any of more than one nozzle hole group 173 (five nozzle hole groups 173 in FIG. 2). As a result of this classification, each nozzle hole group 173 is composed of a first nozzle hole 17*a* and a second nozzle hole 17*b*, whose inclination angles are different and which are arranged in a specified order as illustrated in FIGS. 3 and 4, as the two adjacent fuel nozzle holes 17.

As illustrated in FIG. 2, in the first embodiment, an arrangement order of these nozzle holes 17*a*, 17*b* is set to form such a common order that in any nozzle hole group 173, the second nozzle hole 17*b* is disposed next to the first nozzle hole 17*a* toward one side (in a clockwise direction in FIG. 2) in the circumferential direction.

Figure 5:
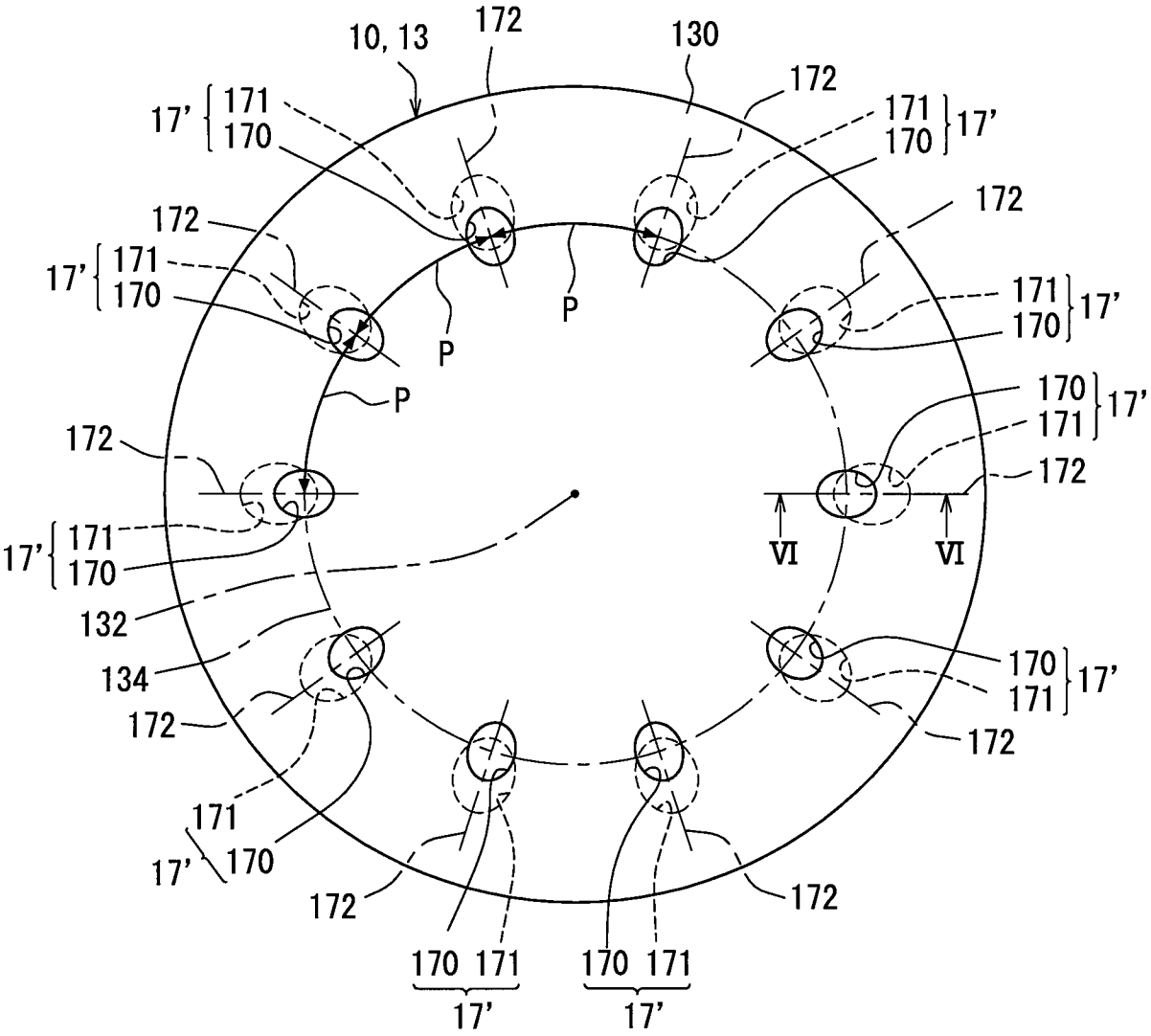
FIG. 5 is an enlarged plan view illustrating imaginary nozzle holes which are assumed in comparison with FIG. 2.
Figure 6:
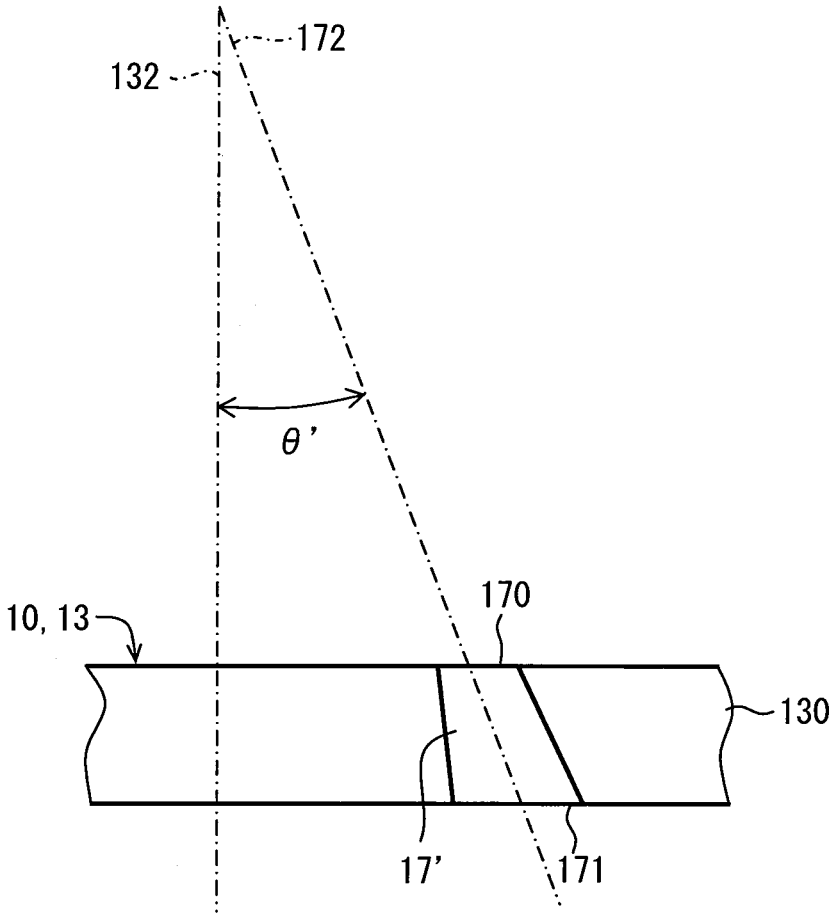
FIG. 6 is an enlarged longitudinal sectional view illustrating an imaginary nozzle hole which is assumed in comparison with FIGS. 3 and 4, and is a sectional view taken along a line VI-VI in FIG. 5.
Figure 7:
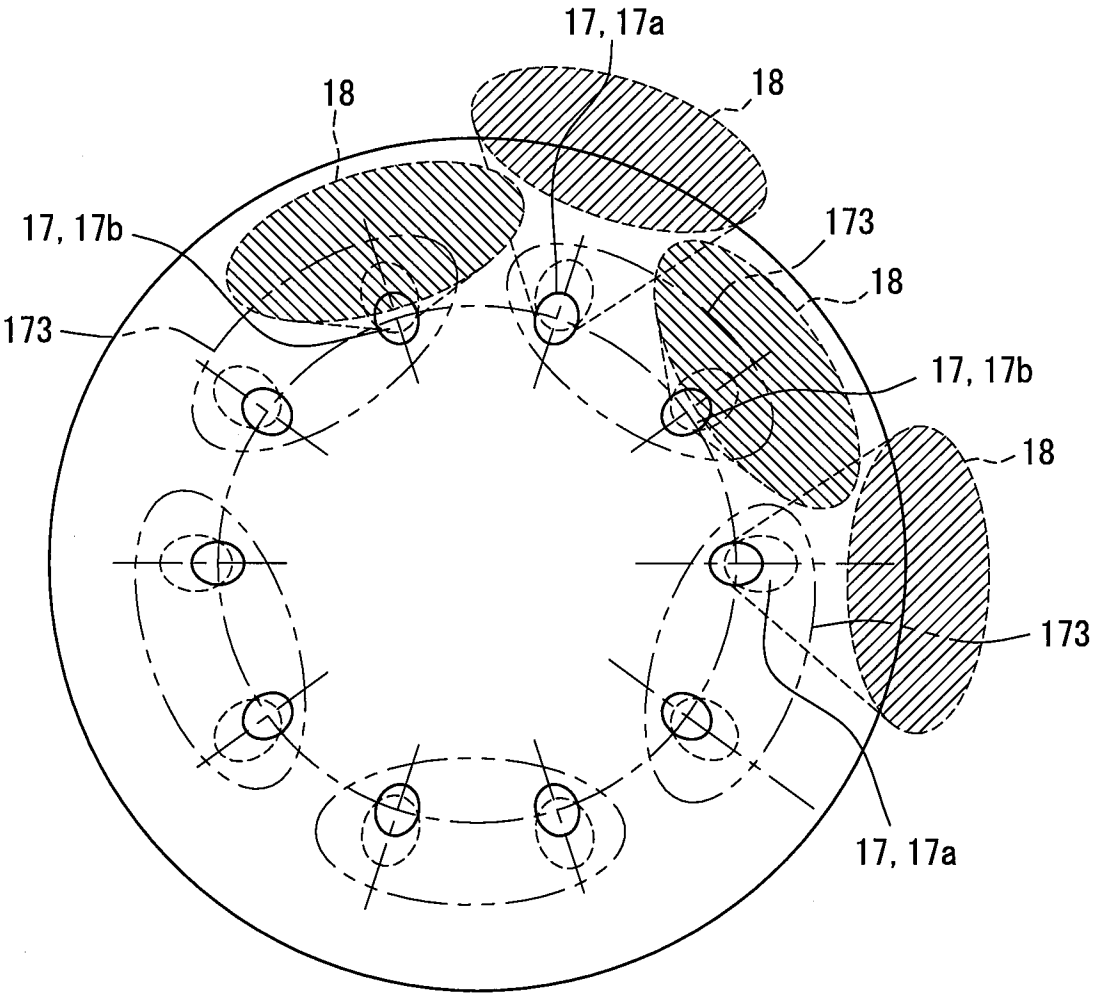
FIG. 7 is a schematic view illustrating operation of the fuel nozzle holes of the first embodiment and its effects.

In the first embodiment, by comparatively assuming an imaginary nozzle hole 17' whose inclination angle is a common angle θ' according as the above-described publication JP-A-H08-277763 as in FIGS. 5 and 6, the respective inclination angles θa, θb of the first and second nozzle holes 17*a*, 17*b* are set as in FIGS. 2 to 4. Specifically, in any nozzle hole group 173, the inclination angle of the first nozzle hole 17*a* is set at an angle θa that is larger than the common angle θ', and the inclination angle of the second nozzle hole 17*b* is set at an angle θb that is smaller than the common angle θ'. Therefore, the inclination angle θa of the first nozzle hole 17*a*, and the inclination angle θb of the second nozzle hole 17*b* satisfy a relation $\theta a > \theta b$. Moreover, with respect to the common angle θ', the respective inclination angles θa, θb of the first and second nozzle holes 17*a*, 17*b* are set to satisfy an approximate expression $\theta' \approx (\theta a + \theta b)/2$. By this setting, fuel sprays 18 (indicated schematically by hatching in FIG. 7) of fuel injected through the fuel nozzle holes 17 (17*a*, 17*b*) as illustrated in FIG. 7 can produce the following operation and effects, with the entire spray configuration which is an overlap between the fuel sprays 18 brought close to, for example, the conventional product.

The operation and effects of the above-described first embodiment will be explained below.

In the first embodiment, the fuel nozzle holes 17, which are disposed in the circumferential direction of the valve housing 10 so as to be arranged with the common pitch P on the common imaginary circle 134, have a common shape around their hole axes 172 that are inclined relative to the central axis 132 on the same longitudinal section as the central axis 132 of the valve housing 10, so that the fuel nozzle holes 17 are easily formed.

Furthermore, according to the first embodiment in which the fuel nozzle holes 17 are classified into any of the nozzle hole groups 173, in each nozzle hole group 173, the inclination angles of the hole axes 172 of the two fuel nozzle holes 17 (17*a*, 17*b*), which are arranged in a predetermined order, relative to the central axis 132 are different. Particularly, in each nozzle hole group 173, an arrangement order of the fuel nozzle holes 17 is set at a common order toward one side in the circumferential direction of the valve housing 10. Accordingly, any fuel nozzle hole 17 has an inclination angle that is different from the circumferentially adjacent fuel nozzle hole 17 in the same group or another group. Thus, the circumferentially adjacent fuel nozzle holes 17 necessarily have different inclination angles from each other. As a result, as illustrated in FIG. 7, the sprays 18 of fuel injected through these fuel nozzle holes 17 have their injection directions reliably shifted so as not to easily collide or interfere with each other. Consequently, the sprays 18 of fuel through these fuel nozzle holes 17 can be separated from each other to limit coarsening of particle diameter of the spray. For this reason, atomization of the fuel spray 18 can be accomplished in the above-described configuration with increased facility in formation of the fuel nozzle holes 17.

Moreover, in each nozzle hole group 173, the second nozzle hole 17*b* is disposed in a common order that is next to the first nozzle hole 17*a* toward one side in the circumferential direction of the valve housing 10. Accordingly, any second nozzle hole 17*b* has an inclination angle that is different from its circumferentially adjacent first nozzle hole 17*a* in the same group or another group. As a result, the injection directions of the fuel sprays 18 are reliably shifted from each other between the first nozzle hole 17*a* and the second nozzle hole 17*b*, which are arranged circumferentially with their inclination angles different from each other. Consequently, collision and interference between the fuel sprays 18 of fuel injected through these nozzle holes 17*a*, 17*b* can be limited. Thus, as a result of employment of the two types of inclination angles, the atomization of the fuel spray 18 can be accomplished with facility in formation of the fuel nozzle holes 17 increased to a maximum extent.

In addition, fuel spreads in a shape of a liquid film along inner walls of the fuel nozzle holes 17 (17*a*, 17*b*) having the shape of a tapered hole whose diameter is increased further from the fuel inlet 170 toward the fuel outlet 171 as a common shape. Accordingly, the fuel spray 18 with small particle diameters is easily injected. Therefore, based on the above-described principle, coupled with the inhibition of the collision and interference between the fuel sprays 18, the atomization of the fuel spray 18 can be promoted in the configuration with increased facility in formation of the fuel nozzle holes 17.

Second Embodiment

A second embodiment illustrated in FIGS. 8 to 12 is a modification to the first embodiment. In the second embodiment, fuel nozzle holes 2017, which are arranged with a common pitch P on a common imaginary circle 134 and each of which having a shape of a tapered hole similar to the first embodiment as a common shape, are classified into any of more than one nozzle hole group 2173 (four nozzle hole groups 2173 in FIG. 8). As a result of this classification, each nozzle hole group 2173 is made up of a first nozzle hole 2017*a*, a second nozzle hole 2017*b*, and a third nozzle hole 2017*c* which are arranged in a given order with their inclination angles different from each other as in FIGS. 8 to 11, as the three adjacent fuel nozzle holes 2017.

Figure 8:
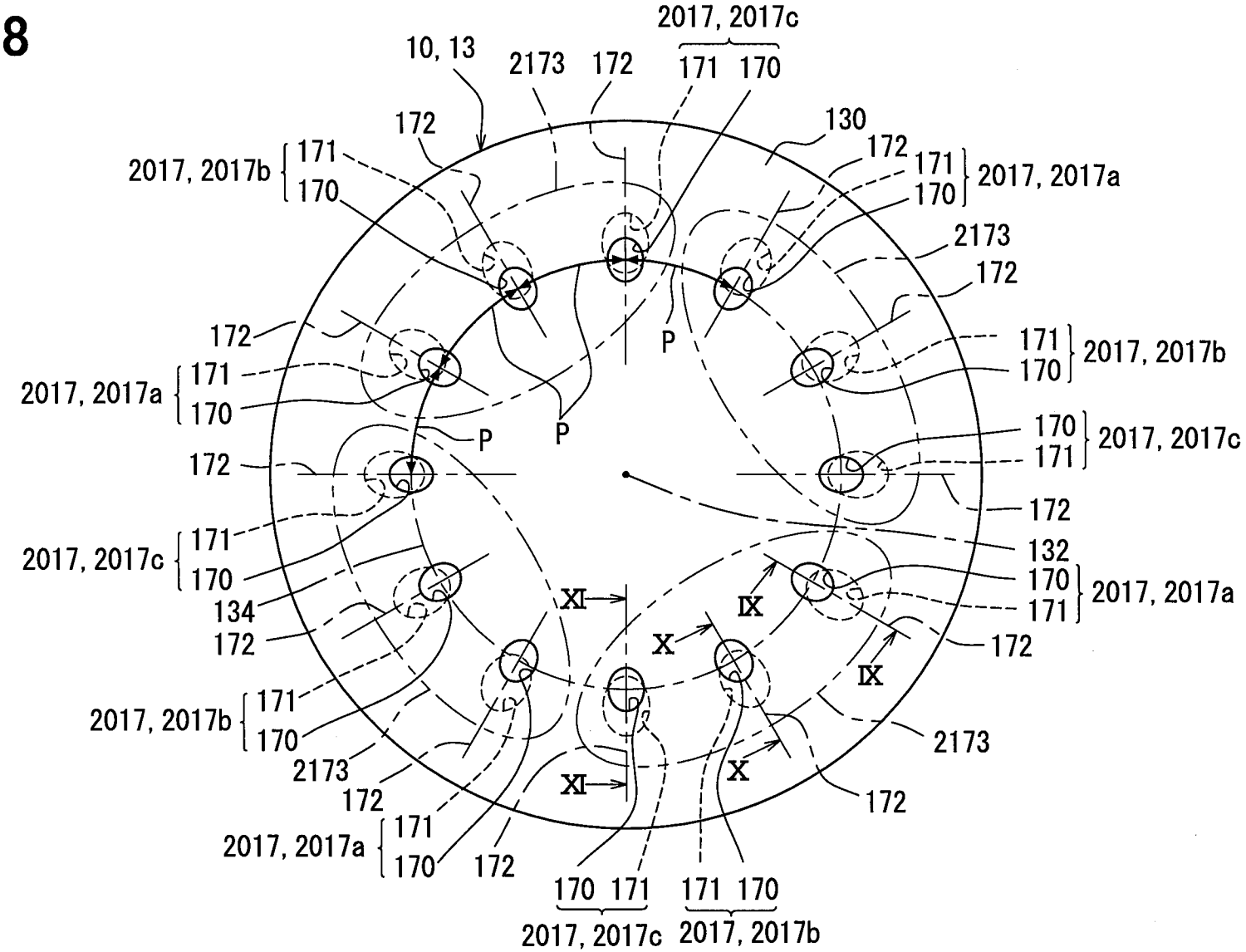
FIG. 8 is an enlarged plan view illustrating fuel nozzle holes of a fuel injection valve in accordance with a second embodiment.
Figure 9:
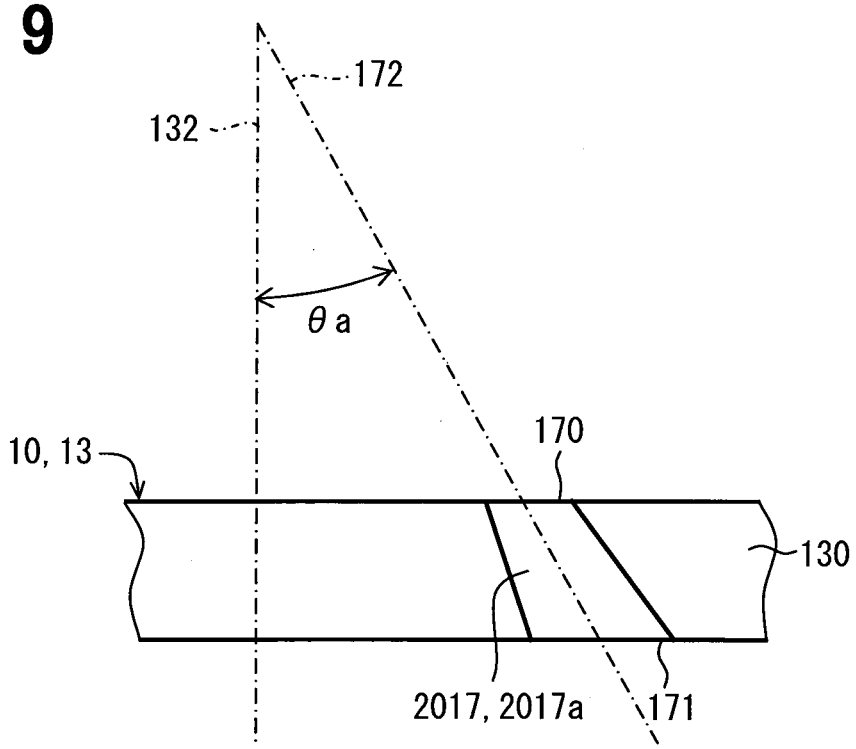
FIG. 9 is an enlarged longitudinal sectional view illustrating the fuel nozzle hole of FIG. 8, and is a sectional view taken along a line IX-IX in FIG. 8.
Figure 10:
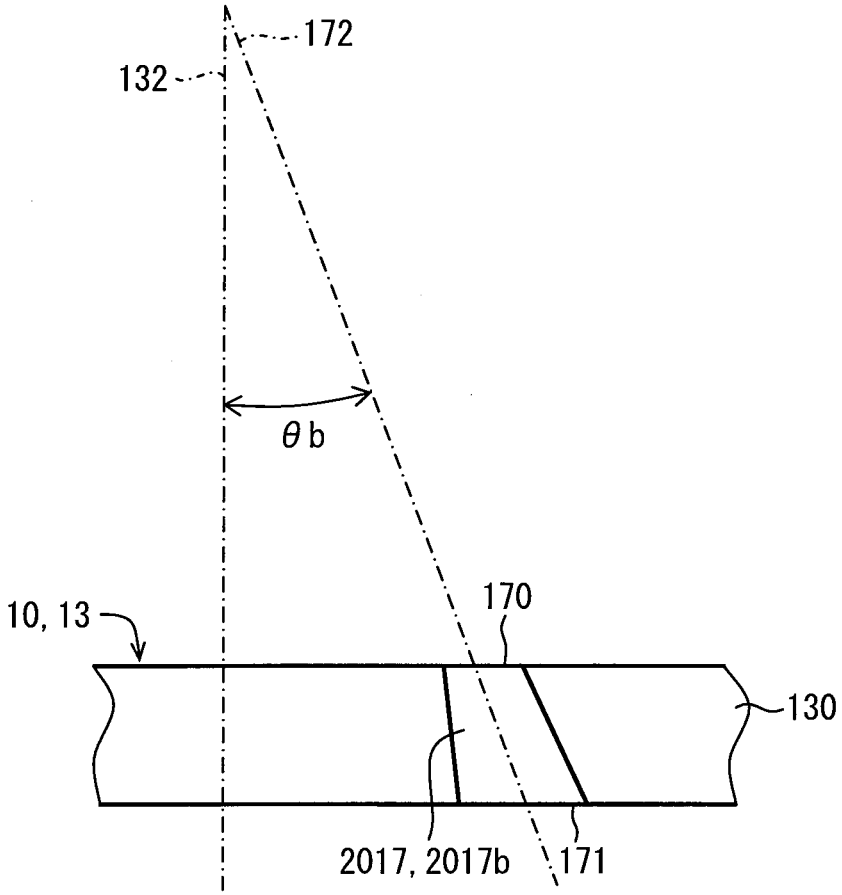
FIG. 10 is an enlarged longitudinal sectional view illustrating the fuel nozzle hole of FIG. 8, and is a sectional view taken along a line X-X in FIG. 8.
Figure 11:
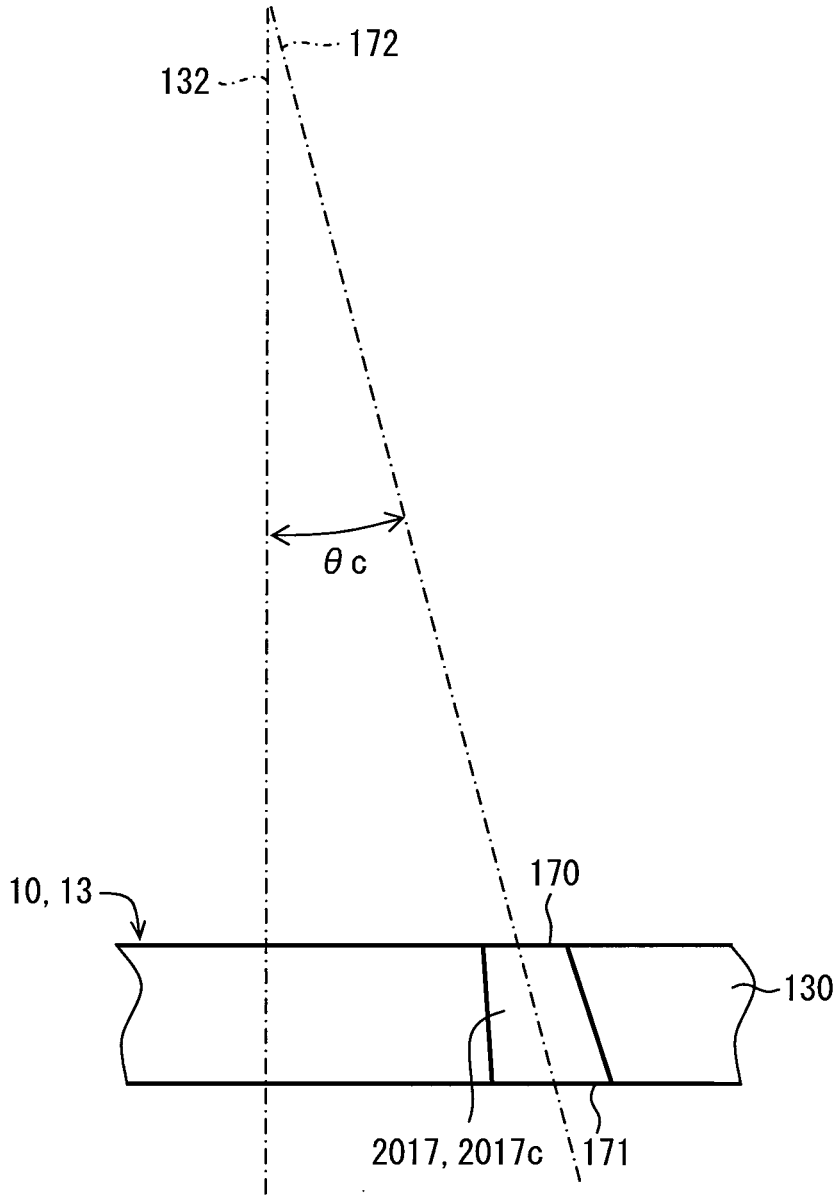
FIG. 11 is an enlarged longitudinal sectional view illustrating the fuel nozzle hole of FIG. 8, and is a sectional view taken along a line XI-XI in FIG. 8.
Figure 12:
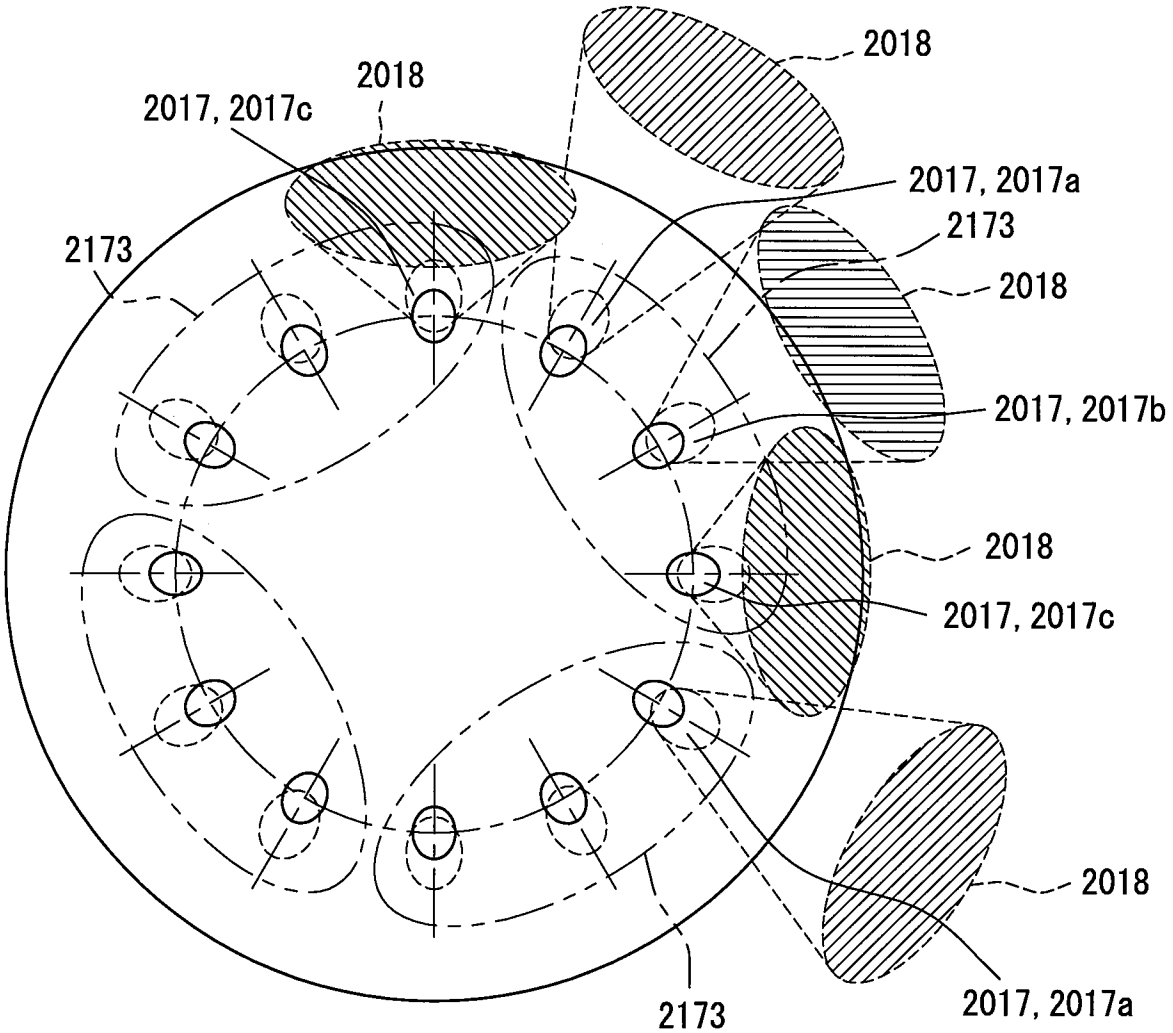
FIG. 12 is a schematic view illustrating operation of the fuel nozzle holes of the second embodiment and its effects.

In the second embodiment, in any nozzle hole group 2173, a common order is set such that the second nozzle hole 2017*b* is arranged next to the first nozzle hole 2017*a*, and the third nozzle hole 2017*c* is arranged next to the second nozzle hole 2017*b* toward one side in a circumferential direction (in a clockwise direction in FIG. 8).

In the second embodiment as well, by comparatively assuming the imaginary nozzle hole 17' with its inclination angle of the common angle θ' as in FIGS. 5 and 6, respective inclination angles θa, θb, θc of the first to third nozzle holes 2017*a*, 2017*b*, 2017*c* are set as illustrated in FIGS. 8 to 11. Specifically, in any nozzle hole group 2173, the inclination angle of the first nozzle hole 2017*a* is set at an angle θa that is larger than the common angle θ' which is substantially the same as an inclination angle θb of the second nozzle hole 2017*b*, and the inclination angle of the third nozzle hole 2017*c* is set at an angle θc that is smaller than the common angle θ'. Accordingly, the inclination angle θa of the first nozzle hole 2017*a*, the inclination angle θb of the second nozzle hole 2017*b*, and the inclination angle θc of the third nozzle hole 2017*c* satisfy a relation $\theta a > \theta b > \theta c$. Moreover, with respect to the common angle θ', the respective inclination angle θa, θb, θc of the first to third nozzle holes 2017*a*, 2017*b*, 2017*c* are set to satisfy an approximate expression $\theta' \approx (\theta a + \theta b + \theta c)/3$. By this setting, sprays 2018 (indicated schematically by hatching in FIG. 12) of fuel injected through the fuel nozzle holes 2017 (2017*a*, 2017*b*, 2017*c*) as in FIG. 12 can produce operation and effects according to the first embodiment with the entire configuration which is an overlap between these sprays 2018 brought close to, for example, the conventional product.

The embodiments have been described above. The present disclosure is not interpreted by limiting to these embodiments, and can be applied to various embodiments and their combination without departing from the scope of the disclosure.

Specifically, as a first modification, a common shape of each fuel nozzle hole 17, 2017 may be, for example, a shape of a straight hole having a constant diameter from the fuel inlet 170 toward the fuel outlet 171, instead of the above-described shape of a tapered hole.

As a second modification, the number of fuel nozzle holes 17, 2017, which constitute each nozzle hole group 173, 2173 can be set appropriately at any other numbers than the above-prescribed number as long as the inclination angles of the fuel nozzle holes 17, 2017 are different from each other in the same nozzle hole group 173, 2173.

Third Embodiment

A third embodiment will be described below in reference to the drawings.

Figure 13:
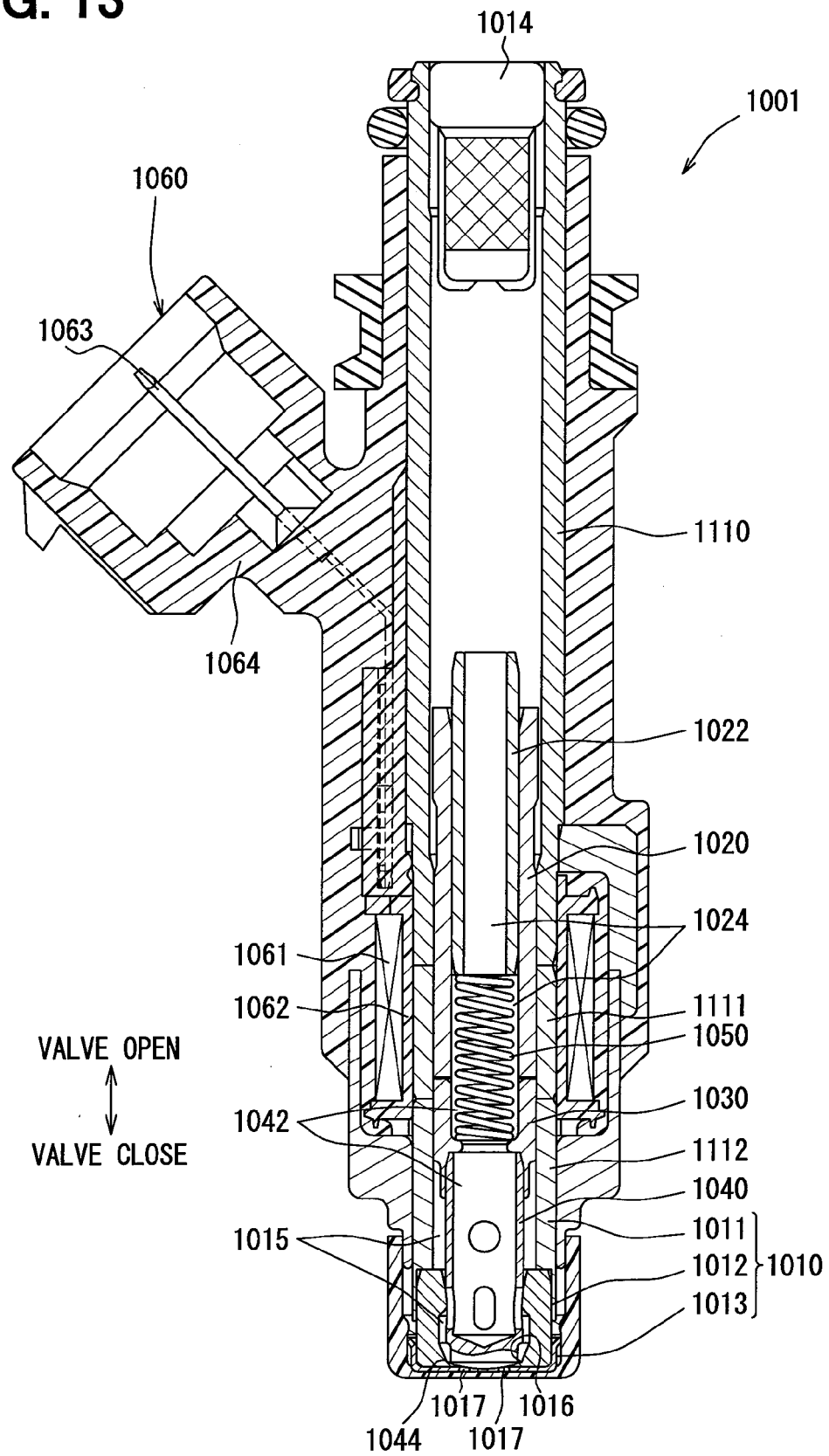
FIG. 13 is a longitudinal sectional view illustrating a fuel injection valve in accordance with a third embodiment.

FIG. 13 illustrates a fuel injection valve 1001 in the third embodiment. The fuel injection valve 1001 is disposed in a gasoline engine as an internal combustion engine to inject fuel into an intake port of this gasoline engine. Besides this applied embodiment, the fuel injection valve 1001 may also inject fuel into, for example, a combustion chamber of a gasoline engine.

Basic configuration of the fuel injection valve 1001 will be described in detail. The fuel injection valve 1001 includes a valve housing 1010, a fixed core 1020, a movable core 1030, a valve member 1040, a resilient member 1050, and a driving unit 1060.

The valve housing 1010 includes a pipe member 1011, a valve body 1012, and a nozzle member 1013. The cylindrical pipe member 1011 includes a first magnetic part 1110, a non-magnetic part 1111, and a second magnetic part 1112 in this order from a valve-open side toward a valve-closed side in an axial direction of the valve 1. The magnetic parts 1110, 1112 made of a metal magnetic material, and the non-magnetic part 1111 made of a metal non-magnetic material are joined together coaxially, for example, through laser welding. By this joining structure, the non-magnetic part 1111 cuts off a short circuit of magnetic flux between the first magnetic part 1110 and the second magnetic part 1112.

The first magnetic part 1110 includes a supply inlet 1014 to which fuel is supplied from a fuel pump (not shown). The second magnetic part 1112 is coaxially and externally fitted and fixed around the valve body 1012 made of a cylindrical metal. Together with the pipe member 1011, the valve body 1012 constitutes a fuel passage 1015 so that the fuel guided from an upstream side can flow toward a downstream side. Also, the valve body 1012 includes a valve seat 1016 exposed to the fuel passage 1015. The nozzle member 1013 made of a cylindrical metal having a bottom part is coaxially and externally fitted and fixed around the valve body 1012 on an opposite side of the valve body 1012 from the second magnetic part 1112. The nozzle member 1013 includes fuel nozzle holes 1017 through its bottom part. Each fuel nozzle hole 1017 communicates with the fuel passage 1015 on a downstream side of the valve seat 1016, and opens radially toward the outside (intake port in this embodiment).

The fixed core 1020 made of a cylindrical metal magnetic material is coaxially fitted and fixed inward of the first magnetic part 1110 and the non-magnetic part 1111. An adjusting pipe 1022 made of a cylindrical metal is coaxially press-fitted and fixed to the fixed core 1020. Together with the adjusting pipe 1022, the fixed core 1020 constitutes a fixed passage 1024 so that the fuel flowing into the valve 1001 through the supply inlet 1014 on the upstream side can flow out to the downstream side.

The movable core 1030 made of a cylindrical metal magnetic material is coaxially accommodated in the non-magnetic part 1111 and the second magnetic part 1112 to be axially reciprocatable on the valve-closed side of the fixed core 1020. The valve member 1040 made of a cylindrical metal non-magnetic material having a bottom part is coaxially accommodated in the second magnetic part 1112 as well as in the valve body 1012, and is fitted and fixed inward of the movable core 1030 on its valve-closed side to be axially reciprocatable. Together with the movable core 1030, the valve member 1040 constitutes a movable passage 1042 to guide the fuel flowing out of the fixed passage 1024 on the upstream side into the fuel passage 1015 on the downstream side.

The valve member 1040 includes a seat part 1044, which reciprocates on the upstream side of the valve seat 1016, at its bottom part on the valve-closed side. The valve member 1040 disengages the seat part 1044 from the valve seat 1016 as a result of its displacement to the valve-open side so as to open each fuel nozzle hole 1017 with respect to the fuel passage 1015. Consequently, the fuel in the fuel passage 1015 is injected radially into the outside (intake port in this embodiment) through the fuel nozzle holes 1017. On the other hand, the valve member 1040 engages its seat part 1044 with the valve seat 1016 as a result of its displacement to the valve-closed side so as to close each fuel nozzle hole 1017 with respect to the fuel passage 1015. Consequently, the fuel injection through the fuel nozzle holes 1017 is stopped. As described above, the valve member 1040 opens or closes each fuel nozzle hole 1017 by its reciprocation movement to be capable of performing or stopping the fuel injection through the fuel nozzle holes 1017.

The resilient member 1050 is a compression coil spring made of metal, and is coaxially accommodated in the respective passages 1024, 1042 of the fixed core 1020 and the movable core 1030. The resilient member 1050 is clamped between the adjusting pipe 1022 in the fixed core 1020 and the movable core 1030. By this clamping structure, the resilient member 1050 generates resilient restoring force in accordance with its compression between the elements 1022, 1030 to urge the movable core 1030 toward the valve-closed side along with the valve member 1040.

The driving unit 1060 includes a solenoid coil 1061, a spool 1062, a terminal 1063, and a connector 1064. The solenoid coil 1061 is formed by winding a metal wiring material around the spool 1062 made of a cylindrical resin. The solenoid coil 1061 is coaxially and externally fitted and fixed around the magnetic parts 1110, 1112 and the non-magnetic part 1111 through the spool 1062. The terminal 1063 made of metal is embedded in the connector 1064 made of resin to make an electric connection between an external control circuit (not shown) and the internal solenoid coil 1061. Through this electric connection, energization of the solenoid coil 1061 can be controlled by the control circuit.

As for valve-opening operation of the above-configured fuel injection valve 1001, as a result of the solenoid coil 1061 energized by the control circuit being excited, a magnetic flux is guided by the first magnetic part 1110, the fixed core 1020, the movable core 1030, and the second magnetic part 1112. Accordingly, magnetic attraction force is produced between the two opposed cores 1020, 1030 to attract the movable core 1030 toward the fixed core 1020 on the valve-open side. Whereupon, the movable core 1030 is driven to the valve-open side together with the valve member 1040 against the urging by the resilient member 1050 so as to collide and engage with the fixed core 1020. Meanwhile, the valve member 1040 disengages the seat part 1044 from the valve seat 1016, and fuel is thereby injected through each fuel nozzle hole 1017.

On the other hand, as for valve-closing operation after such a valve-opening operation, the solenoid coil 1061 whose energization is stopped by the control circuit is demagnetized, and the magnetic attraction force between the cores 1020, 1030 thereby disappears. Whereupon, the movable core 1030 is driven to valve-closed side together with the valve member 1040 by the resilient member 1050, so that the bottom part of the valve member 1040 collides and engages with the valve body 1012. Accordingly, the valve member 1040 engages its seat part 1044 with the valve seat 1016 thereby to stop the fuel injection through each fuel nozzle hole 1017.

A mode of formation of the fuel nozzle hole 1017 will be described in detail.

Figure 14:
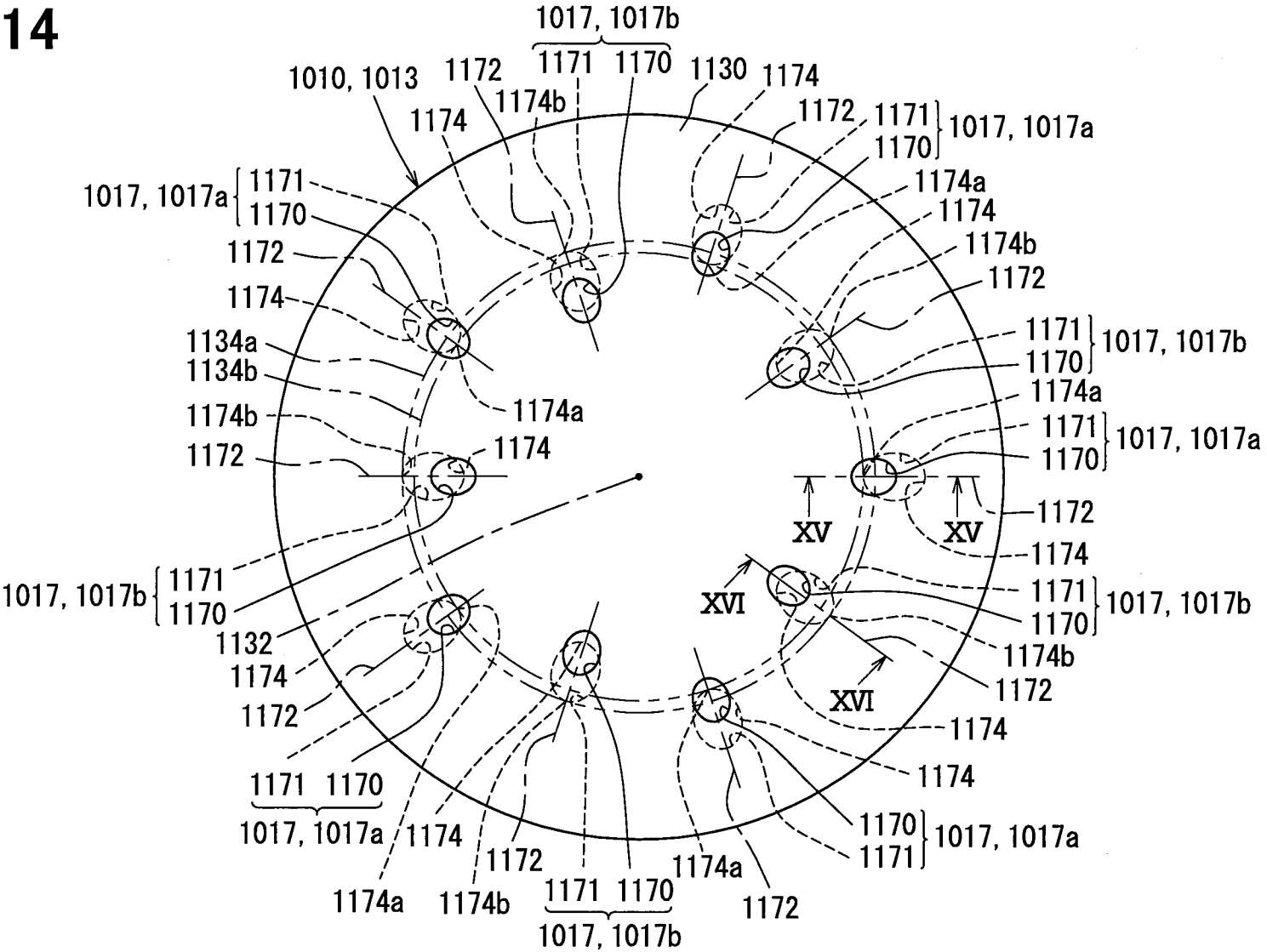
FIG. 14 is an enlarged plan view illustrating fuel nozzle holes of the third embodiment.
Figure 15:
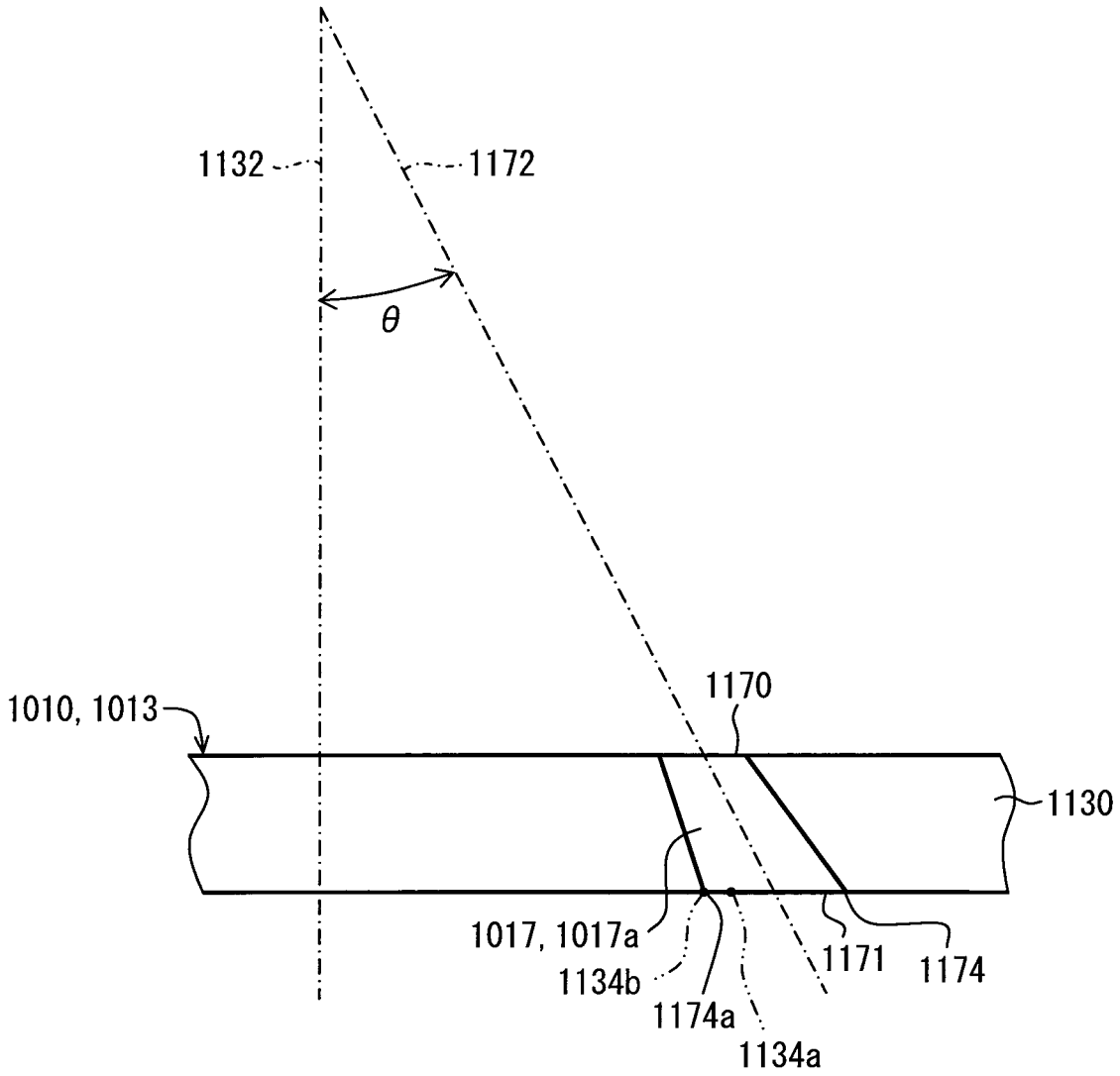
FIG. 15 is an enlarged longitudinal sectional view illustrating the fuel nozzle hole in FIG. 14, and is a sectional view taken along a line XV-XV in FIG. 14.
Figure 16:
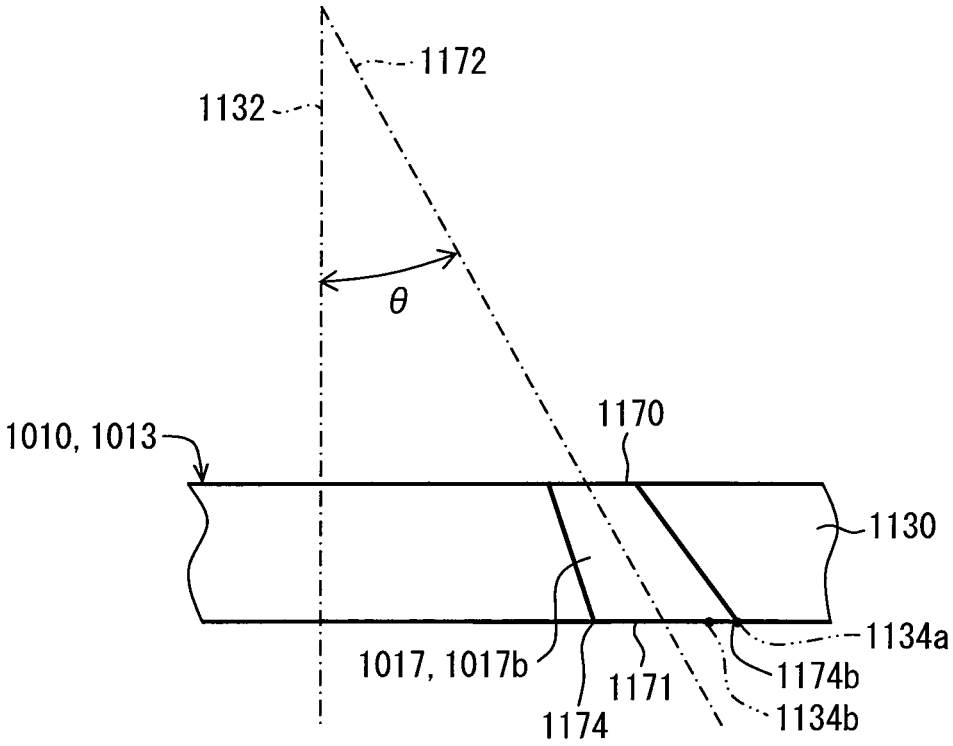
FIG. 16 is an enlarged longitudinal sectional view illustrating the fuel nozzle hole in FIG. 14, and is a sectional view taken along a line XVI-XVI in FIG. 14.

Through a circular disk-shaped nozzle plate 1130 which is the bottom part of the nozzle member 1013 of the valve housing 1010 illustrated in FIGS. 14 to 16, the fuel nozzle holes 1017 are arranged in a circumferential direction around the central axis 1132 of the plate 1130. As a common shape around a hole axis 1172, each fuel nozzle hole 1017 has a shape of a tapered hole whose diameter is increased further from a fuel inlet 1170 toward a fuel outlet 1171. Each of the fuel nozzle holes 1017 having this common shape is inclined to an outer peripheral side of the nozzle plate 1130 further from the fuel inlet 1170 toward the fuel outlet 1171. The hole axis 1172 of each fuel nozzle hole 1017 is inclined relative to the central axis 1132 on the same longitudinal section (in FIGS. 15 and 16) as the central axis 1132, and a constant angle θ is made between the hole axis 1172 and the central axis 1132. In other words, the hole axis 1172 of each fuel nozzle hole 1017 intersects with the central axis 1132 at a common inclination angle θ.

Figure 18:
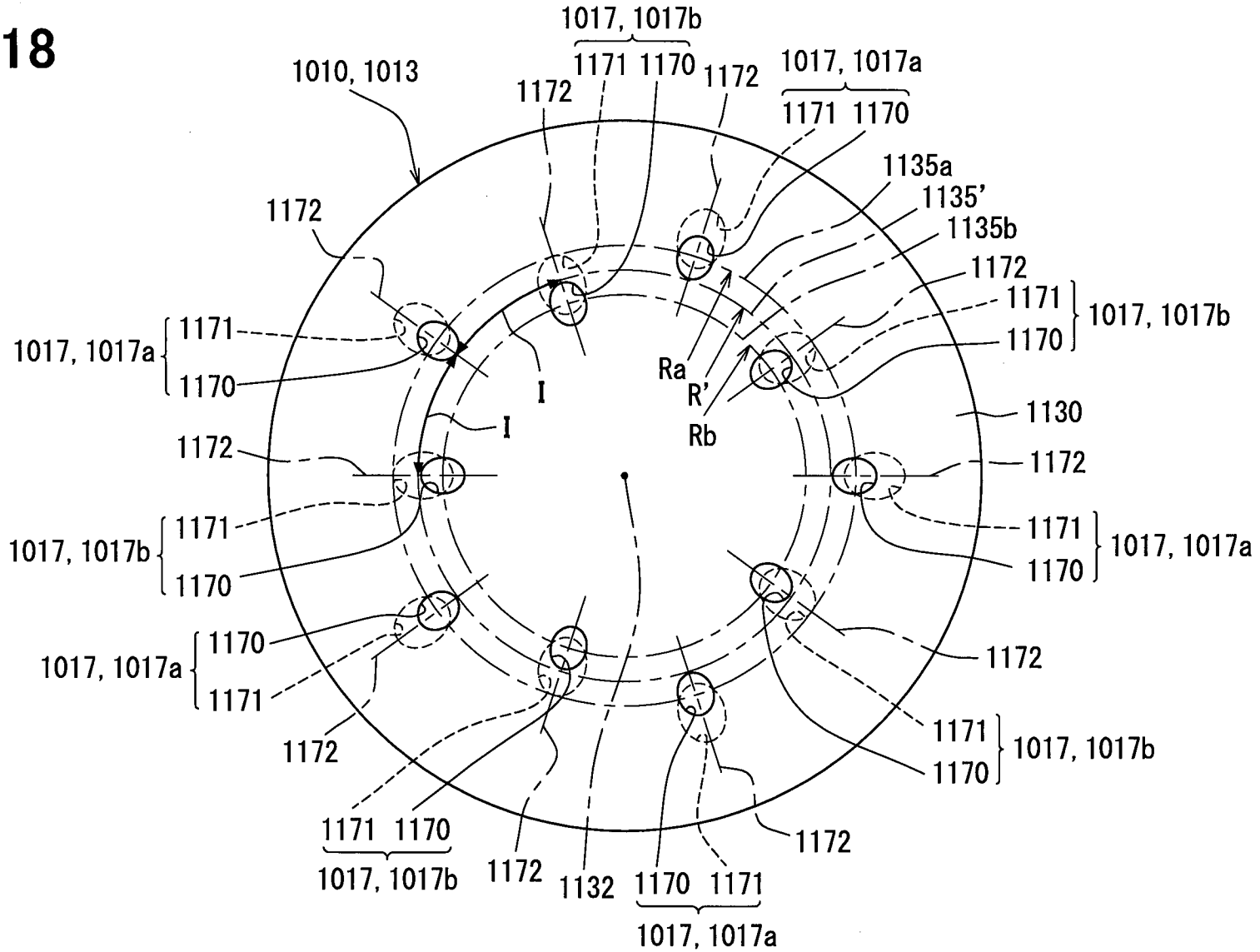
FIG. 18 is a diagram illustrating characteristics of the fuel nozzle hole in FIG. 14, and is an enlarged plan view corresponding to FIG. 14.

As illustrated in FIG. 14, on the valve housing 1010, an outer imaginary circle 1134*a*, and an inner imaginary circle 1134*b* located inward of the outer imaginary circle 1134*a*, are defined concentrically with each other as well as concentrically with the nozzle plate 1130. Each fuel nozzle hole 1017 is classified into one of an outer nozzle hole 1017*a* through which the outer imaginary circle 1134*a* passes on the fuel outlet 1171-side, and an inner nozzle hole 1017*b* through which the inner imaginary circle 1134*b* passes on the fuel outlet 1171-side. By such a classification, the two or more outer nozzle holes 1017*a* and the two or more inner nozzle holes 1017*b* (five nozzle holes 1017*a* and five nozzle holes 1017*b* in FIG. 14) are arranged alternately at regular intervals I in the circumferential direction as illustrated in FIG. 18. The regular intervals of I is a distance between the longitudinal sections including the central axis 1132 and the respective hole axes 1172 in the circumferential direction.

The inventors have been researching modes of arrangement of the outer nozzle holes 1017*a* and the inner nozzle holes 1017*b*. As a result, by optimizing a positional relationship between opening edge portions 1174 of the outer nozzle holes 1017*a*, and opening edge portions 1174 of the inner nozzle holes 1017*b* on the fuel outlet 1171-side as illustrated in FIG. 14, controllability of penetrations of sprays of fuel injected through the outer nozzle holes 1017*a* and the inner nozzle holes 1017*b* can be enhanced, and atomization of the fuel spray can be promoted.

More specifically, as illustrated in FIGS. 14 to 16, on the fuel outlet 1171-side of the outer nozzle hole 1017*a*, an innermost peripheral edge portion 1174*a* of the opening edge portion 1174 that is located on the innermost peripheral side on the valve housing 1010 (nozzle plate 1130) is positioned on the inner imaginary circle 1134*b*; and the outer imaginary circle 1134*a* passes through an outer peripheral side of the innermost peripheral edge portion 1174*a*. Moreover, on the fuel outlet 1171-side of the inner nozzle hole 1017*b*, an outermost peripheral edge portion 1174*b* of the opening edge portion 1174 that is located on the outermost peripheral side on the valve housing 1010 (nozzle plate 1130) is positioned on the outer imaginary circle 1134*a*; and the inner imaginary circle 1134*b* passes through an inner peripheral side of the outermost peripheral edge portion 1174*b*.

Figure 17:
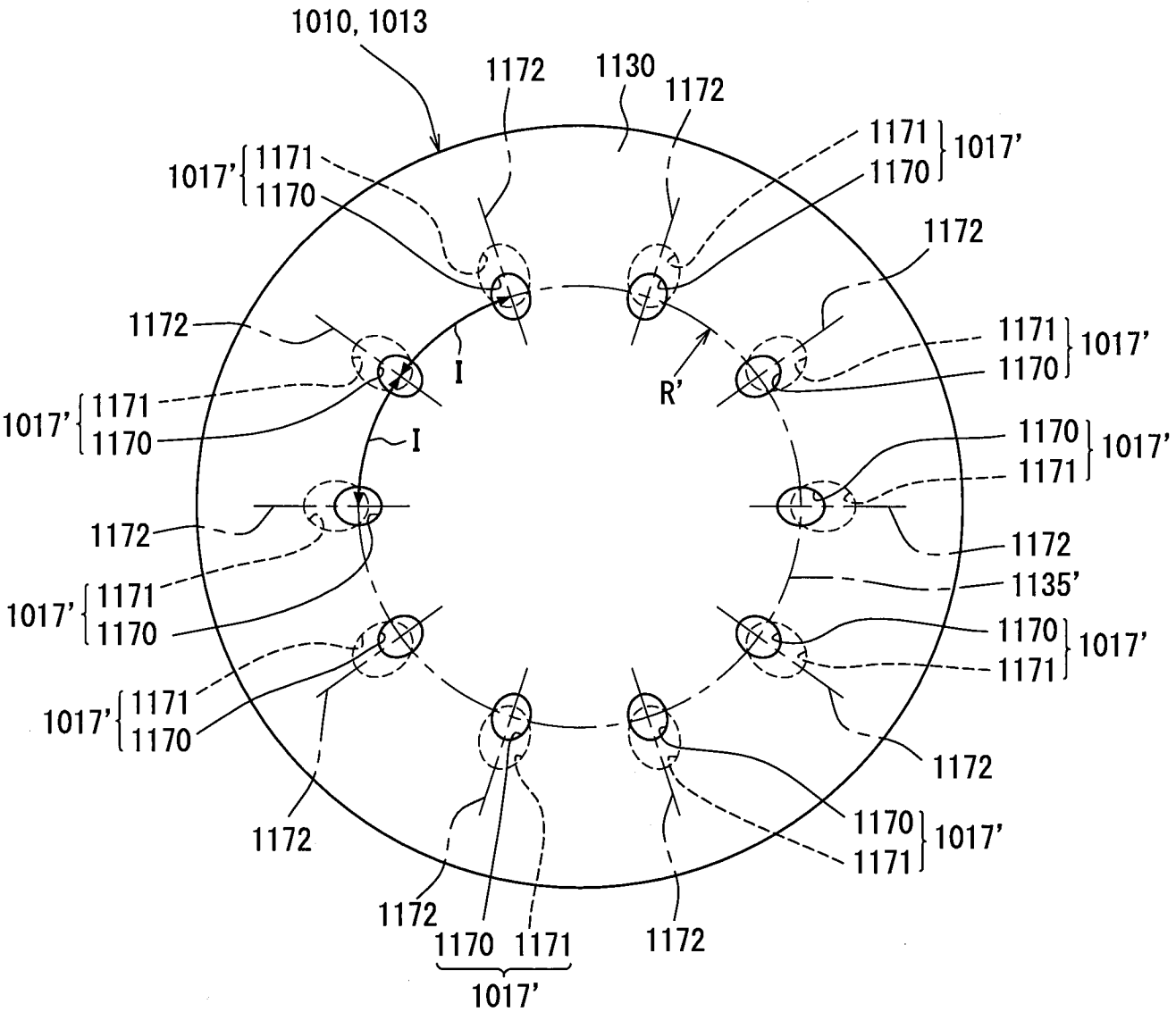
FIG. 17 is an enlarged plan view illustrating imaginary nozzle holes which are assumed in comparison with FIG. 14.
Figure 19:
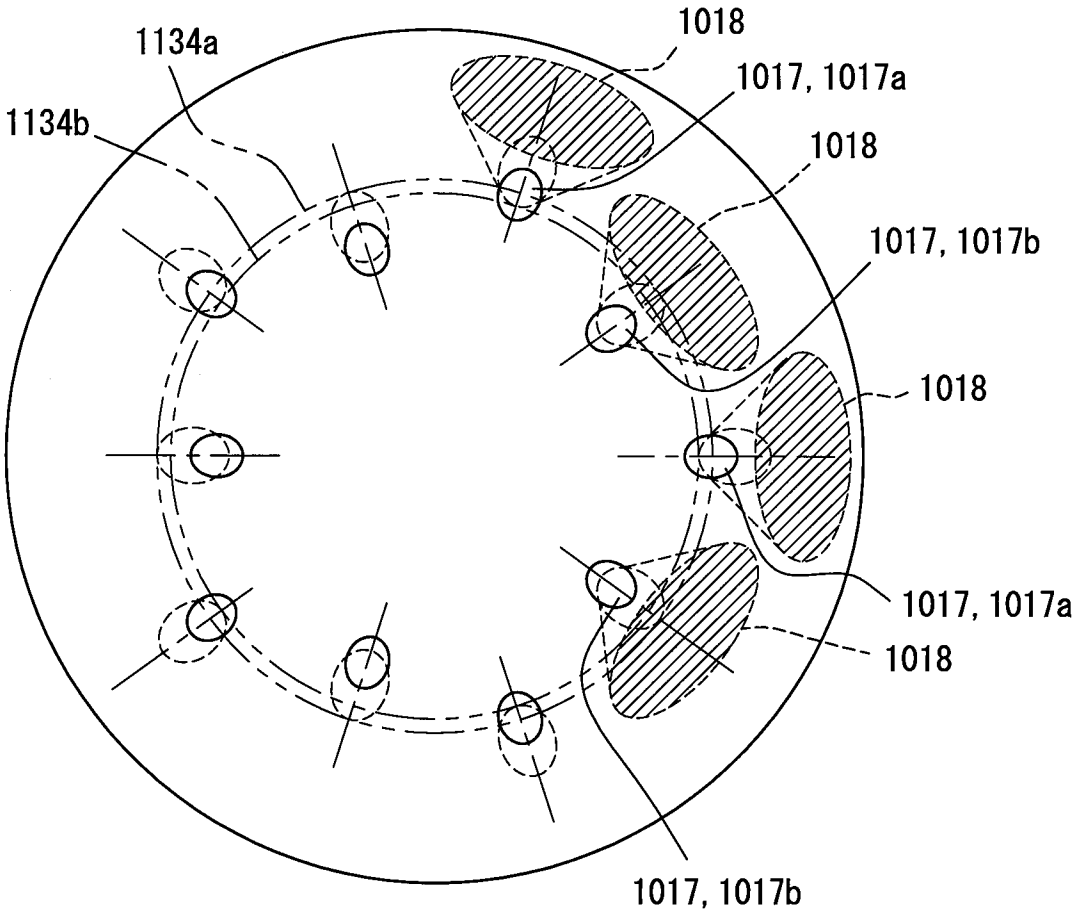
FIG. 19 is a schematic view illustrating operation of the fuel nozzle holes and its effects according to the third embodiment.

Furthermore, in the present embodiment, according as the above-described publication JP-A-H08-277763, by comparatively assuming such imaginary nozzle holes 1017' that an imaginary pitch circle 1135' intersects with the hole axis 1172 on the fuel inlet 1170-side as illustrated in FIG. 17, the mode of arrangement of the outer nozzle holes 1017*a* and the inner nozzle holes 1017*b* is set. Specifically, as illustrated in FIG. 18, there are defined an outer pitch circle 1135*a* which intersects with the hole axis 1172 of each outer nozzle hole 1017*a* on the fuel inlet 1170-side, and an inner pitch circle 1135*b* which intersects with the hole axis 1172 of each inner nozzle hole 1017*b* on the fuel inlet 1170-side. Based on this definition, with respect to a radius R' of the imaginary pitch circle 1135', a radius Ra of the outer pitch circle 1135*a* and a radius Rb of the inner pitch circle 1135*b* are set to satisfy an approximate expression $R' \approx (Ra+Rb)/2$. By this setting, fuel sprays 1018 (indicated schematically by hatching in FIG. 19) of fuel injected through the fuel nozzle holes 1017 (1017*a*, 1017*b*) as illustrated in FIG. 19 can produce the following operation and effects, with the entire spray configuration which is an overlap between the fuel sprays 1018 brought close to, for example, the conventional product.

The operation and effects of the above-described fuel injection valve 1001 will be explained below.

In the fuel injection valve 1001, the outer nozzle holes 1017*a* and the inner nozzle holes 1017*b*, as the fuel nozzle holes 1017 through which the outer imaginary circle 1134*a*, and the concentric inner imaginary circle 1134*b* radially inward of the outer imaginary circle 1134*a* pass respectively on the fuel outlet 1171-side, are arranged alternately in the circumferential direction of the valve housing 1010. As a result, the outer nozzle holes 1017*a* and the inner nozzle holes 1017*b* are arranged adjacent to each other in the circumferential direction. Accordingly, the sprays 1018 of fuel injected through the outer nozzle holes 1017*a* and the inner nozzle holes 1017*b* do not easily collide or interfere with each other. Consequently, coarsening of particle diameter of the spray can be limited so as to enable the atomization of the fuel spray 1018.

On the fuel outlet 1171-side of each fuel nozzle hole 1017, the innermost peripheral edge portion 1174*a* of the opening edge portion 1174 of the outer nozzle hole 1017*a* that is located on the innermost peripheral side on the valve housing 1010 is positioned on the inner imaginary circle 1134*b*. Moreover, on the fuel outlet 1171-side of each fuel nozzle hole 1017, the outermost peripheral edge portion 1174*b* of the opening edge portion 1174 of the inner nozzle hole 1017*b* that is located on the outermost peripheral side on the valve housing 1010 is positioned on the outer imaginary circle 1134*a*. As a result, as for the outer imaginary circle 1134*a* passing through an outer peripheral side of the innermost peripheral edge portion 1174*a* of the outer nozzle hole 1017*a*, and the inner imaginary circle 1134*b* passing through an inner peripheral side of the outermost peripheral edge portion 1174*b* of the inner nozzle hole 1017*b*, a radial distance between the outer imaginary circle 1134*a* and the inner imaginary circle 1134*b* is made as small as possible. Accordingly, between the sprays 1018 of fuel injected through the outer nozzle hole 1017*a* and the inner nozzle hole 1017*b*, which are adjacent to each other, attracting force due to the Coanda effect can be increased, and a particle diameter difference because of a difference between the fuel flows on the upstream side can be reduced. Thus, controllability of penetration of the fuel spray 1018 can be enhanced as a result of the increase of the attracting force, and the atomization of the fuel spray 1018 can be promoted owing to the reduction of a difference between particle diameters of the spray.

Additionally, the outer nozzle holes 1017*a* and the inner nozzle holes 1017*b*, which are arranged alternately at regular intervals (I) in the circumferential direction, have a common shape around the respective hole axes 1172 that are inclined relative to the central axis 1132 of the valve housing 1010 on the same longitudinal section as the central axis 1132 of the valve housing 1010. Consequently, the outer nozzle holes 1017*a* and the inner nozzle holes 1017*b* are easily formed. Furthermore, the outer nozzle hole 1017*a* and the inner nozzle hole 1017*b*, which have a common inclination angle θ of their hole axes 1172 relative to the central axis 1132, are formed highly easily, and also a particle diameter difference between the sprays 1018 of fuel injected through the outer nozzle hole 1017*a* and the inner nozzle hole 1017*b* can be reliably reduced. As a result of these, in the configuration of the valve 1001 with increased facility in formation of the outer nozzle holes 1017*a* and the inner nozzle holes 1017*b*, the promoting effect on the atomization of the fuel spray 1018 can be improved.

In addition, because fuel spreads in a shape of a liquid film along inner walls of the outer nozzle hole 1017*a* and the inner nozzle hole 1017*b* with the shape of a tapered hole whose diameter is increased further from the fuel inlet 1170 toward the fuel outlet 1171 being their common shape, the fuel spray 1018 with small particle diameters is easily injected. Therefore, the promoting effect on the atomization of the fuel spray 1018 can be improved.

The third embodiment has been described above. The present disclosure is not interpreted by limiting to this embodiment, and can be applied to various embodiments without departing from the scope of the disclosure.

Specifically, as a third modification, the common shape between the outer nozzle hole 1017*a* and the inner nozzle hole 1017*b* may be, for example, a shape of a straight hole having a constant diameter from the fuel inlet 1170 toward the fuel outlet 1171, instead of the above-described shape of a tapered hole.

As a fourth modification, as long as a positional relationship of the edge portions 1174*a*, 1174*b* is optimized as described above, the shapes of the fuel nozzle holes 1017 may be different between the outer nozzle holes 1017*a* and the inner nozzle holes 1017*b*, may be different between the outer nozzle holes 1017*a*, or may be different between the inner nozzle holes 1017*b*.

As a fifth modification, provided that a positional relationship of the edge portions 1174*a*, 1174*b* is optimized as described above, the inclination angles 8 of the hole axes 1172 relative to the central axis 1132 may be different between the outer nozzle holes 1017*a* and the inner nozzle holes 1017*b*, may be different between the outer nozzle holes 1017*a*, or may be different between the inner nozzle holes 1017*b*.

As a sixth modification, only if a positional relationship of the edge portions 1174*a*, 1174*b* is optimized as described above, at least one of the outer nozzle hole 1017*a* and the inner nozzle hole 1017*b* may be formed such that its hole axis 1172 is inclined on a section different from the central axis 1132 as long as it is inclined to the outer peripheral side further from the fuel inlet 1170 toward the fuel outlet 1171.

To sum up, the fuel injection valve 1, 1001 in accordance with the above embodiments can be described as follows.

A fuel injection valve 1 is disposed in an internal combustion engine for injecting fuel radially. The valve 1 includes a valve housing 10 and a valve member 40. The valve housing 10 includes a plurality of fuel nozzle holes 17, 17*a*, 17*b*; 2017, 2017*a*, 2017*b*, 2017*c* arranged in a circumferential direction of the valve housing 10 with a common pitch P on a common imaginary circle 134. Each of the plurality of fuel nozzle holes 17, 17*a*, 17*b*; 2017, 2017*a*, 2017*b*, 2017*c* includes a fuel inlet 170 and a fuel outlet 171, and is inclined toward an outer peripheral side in a direction from the fuel inlet 170 to the fuel outlet 171. The plurality of fuel nozzle holes 17, 17*a*, 17*b*; 2017, 2017*a*, 2017*b*, 2017*c* have hole axes 172, which are inclined relative to a central axis 132 of the valve housing 10 on the same longitudinal section as the central axis 132, and have a common shape around their hole axes 172. The plurality of fuel nozzle holes 17; 2017 are classified into any of a plurality of nozzle hole groups 173, 2173. Each of the plurality of nozzle hole groups 173, 2173 includes at least two 17*a*, 17*b*; 2017*a*, 2017*b*, 2017*c* of the plurality of fuel nozzle holes 17; 2017. The at least two 17*a*, 17*b*; 2017*a*, 2017*b*, 2017*c* of the plurality of fuel nozzle holes 17; 2017 are arranged in a predetermined order with different inclination angles θa, θb, θc of their hole axes 172 relative to the central axis 132. The order of the arrangement of the at least two 17*a*, 17*b*; 2017*a*, 2017*b*, 2017*c* of the plurality of fuel nozzle holes 17; 2017 is set at a common order toward one side in the circumferential direction of the valve housing 10, among the plurality of nozzle hole groups 173, 2173. The valve member 40 is accommodated and configured to reciprocate in the valve housing 10 to open or close the plurality of fuel nozzle holes 17, 17*a*, 17*b*; 2017, 2017*a*, 2017*b*, 2017*c*, thereby performing or stopping the fuel injection through the plurality of fuel nozzle holes 17, 17*a*, 17*b*; 2017, 2017*a*, 2017*b*, 2017*c*.

Accordingly, the fuel nozzle holes 17, 17*a*, 17*b*, 2017, 2017*a*, 2017*b*, 2017*c* which are disposed in the circumferential direction of the valve housing 10 so as to be arranged with the common pitch P on the common imaginary circle 134, have a common shape around their hole axes 172 that are inclined relative to the central axis 132 on the same longitudinal section as the central axis 132 of the valve housing 10, so that the fuel nozzle holes 17, 17*a*, 17*b*, 2017, 2017*a*, 2017*b*, 2017*c* are easily formed.

Furthermore, according to the present disclosure in which the fuel nozzle holes 17, 2017 are classified into any of the nozzle hole groups 173, 2173, in each nozzle hole group 173, 2173 the inclination angles θa, θb, θc of the hole axes 172 of at least two fuel nozzle holes 17*a*, 17*b*, 2017*a*, 2017*b*, 2017*c*, which are arranged in a predetermined order, relative to the central axis 132 are different. Particularly, in each nozzle hole group 173, 2173, an arrangement order of the fuel nozzle holes 17, 2017 is set at a common order toward one side in the circumferential direction of the valve housing 10. Accordingly, any fuel nozzle hole 17, 2017 has an inclination angle θa, θb, θc that is different from the circumferentially adjacent fuel nozzle hole 17, 2017 in the same group or another group. Thus, the circumferentially adjacent fuel nozzle holes 17, 2017 necessarily have different inclination angles θa, θb, θc from each other. As a result, the sprays 18, 2018 of fuel injected through these fuel nozzle holes 17, 2017 have their injection directions reliably shifted so as not to easily collide or interfere with each other. Consequently, the sprays 18, 2018 of fuel through these fuel nozzle holes 17, 2017 can be separated from each other to limit coarsening of particle diameter of the spray 18, 2018. For this reason, atomization of the fuel spray 18, 2018 can be accomplished also in the above-described configuration with increased facility in formation of the fuel nozzle holes 17, 2017.

Each of the plurality of nozzle hole groups 173 may include a first nozzle hole 17*a* and a second nozzle hole 17*b* as two (17*a*, 17*b*) of the plurality of fuel nozzle holes 17. The second nozzle hole 17*b* is arranged next to the first nozzle hole 17*a* in the common order toward the one side in the circumferential direction of the valve housing 10. An inclination angle θb of a hole axis 172 of the second nozzle hole 17*b* relative to the central axis 132 is different from an inclination angle θa of a hole axis 172 of the first nozzle hole 17*a* relative to the central axis 132.

As a result of the above-described characteristics, in each nozzle hole group 173, the second nozzle hole 17*b* is disposed in a common order that is next to the first nozzle hole 17*a* toward one side in the circumferential direction of the valve housing 10. Accordingly, any second nozzle hole 17*b* has an inclination angle θb that is different from its circumferentially adjacent first nozzle hole 17*a* in the same group or another group. As a result, the injection directions of the fuel sprays 18 are reliably shifted from each other between the first nozzle hole 17*a* and the second nozzle hole 17*b*, which are arranged circumferentially with their inclination angles θa, θb different from each other. Consequently, collision and interference between the fuel sprays 18 of fuel injected through these nozzle holes 17*a*, 17*b* can be limited. Thus, as a result of employment of the two types of inclination angles θa, θb, the atomization of the fuel spray 18 can be accomplished with facility in formation of the fuel nozzle holes 17 increased to a maximum extent.

The inventors have been researching modes of arrangement of the outer nozzle holes 1017*a* and the inner nozzle holes 1017*b* through which the outer imaginary circle 1134*a*, and the concentric inner imaginary circle 1134*b* radially inward of the circle 1134*a* respectively pass. As a result, by optimizing a positional relationship between the opening edge portion 1174 of the outer nozzle hole 1017*a* and the opening edge portion 1174 of the inner nozzle hole 1017*b* on the fuel outlet 1171-side, penetration controllability of the sprays 1018 of fuel injected through the outer nozzle holes 1017*a* and the inner nozzle holes 1017*b* can be enhanced, and atomization of the fuel sprays 1018 can be promoted.

A fuel injection valve 1001 is disposed in an internal combustion engine for injecting fuel radially. The valve 1001 includes a valve housing 1010 and a valve member 1040. The valve housing 1010 includes a plurality of fuel nozzle holes 1017 arranged in a circumferential direction of the valve housing 1010. Each of the plurality of fuel nozzle holes 1017 includes a fuel inlet 1170 and a fuel outlet 1171, and is inclined toward an outer peripheral side in a direction from the fuel inlet 1170 to the fuel outlet 1171. An outer imaginary circle 1134*a* is defined along the circumferential direction of the valve housing 1010. An inner imaginary circle 1134*b* is defined radially inward of the outer imaginary circle 1134*a* and concentrically with the outer imaginary circle 1134*a*. The plurality of fuel nozzle holes 1017 includes a plurality of outer nozzle holes 1017*a* and a plurality of inner nozzle holes 1017*b*, which are arranged alternately in the circumferential direction of the valve housing 1010. An opening edge portion 1174 of each of the plurality of outer nozzle holes 1017*a* on its fuel outlet 1171-side includes an innermost peripheral edge portion 1174*a*, which is located on the innermost peripheral side of the valve housing 1010 and is positioned on the inner imaginary circle 1134*b*. The outer imaginary circle 1134*a* passes through an outer peripheral side of the innermost peripheral edge portion 1174*a*. An opening edge portion 1174 of each of the plurality of inner nozzle holes 1017*b* on its fuel outlet 1171-side includes an outermost peripheral edge portion 1174*b*, which is located on the outermost peripheral side of the valve housing 1010 and is positioned on the outer imaginary circle 1134*a*. The inner imaginary circle 1134*b* passes through an inner peripheral side of the outermost peripheral edge portion 1174*b*. The valve member 1040 is accommodated and configured to reciprocate in the valve housing 1010 to open or close the plurality of fuel nozzle holes 1017, thereby performing or stopping the fuel injection through the plurality of fuel nozzle holes 1017.

As a consequence of this, the outer nozzle holes 1017*a* and the inner nozzle holes 1017*b*, as the fuel nozzle holes 1017 through which the outer imaginary circle 1134*a*, and the concentric inner imaginary circle 1134*b* radially inward of the outer imaginary circle 1134*a* pass respectively on the fuel outlet 1171-side, are arranged alternately in the circumferential direction of the valve housing 1010. As a result, the outer nozzle holes 1017*a* and the inner nozzle holes 1017*b* are arranged adjacent to each other in the circumferential direction. Accordingly, the sprays 1018 of fuel injected through the outer nozzle holes 1017*a* and the inner nozzle holes 1017*b* do not easily collide or interfere with each other. Consequently, coarsening of particle diameter of the spray 1018 can be limited so as to enable the atomization of the fuel spray 1018.

Furthermore, on the fuel outlet 1171-side of each fuel nozzle hole 1017, the innermost peripheral edge portion 1174*a* of the opening edge portion 1174 of the outer nozzle hole 1017*a* that is located on the innermost peripheral side on the valve housing 1010 is positioned on the inner imaginary circle 1134*b*. In addition, the outermost peripheral edge portion 1174*b* of the opening edge portion 1174 of the inner nozzle hole 1017*b* that is located on the outermost peripheral side on the valve housing 1010 is positioned on the outer imaginary circle 1134*a*. As a result, as for the outer imaginary circle 1134*a* passing through an outer peripheral side of the innermost peripheral edge portion 1174*a* of the outer nozzle hole 1017*a*, and the inner imaginary circle 1134*b* passing through an inner peripheral side of the outermost peripheral edge portion 1174*b* of the inner nozzle hole 1017*b*, a radial distance between the outer imaginary circle 1134*a* and the inner imaginary circle 1134*b* is made as small as possible. Accordingly, between the sprays 1018 of fuel injected through the outer nozzle hole 1017*a* and the inner nozzle hole 1017*b*, which are adjacent to each other, attracting force due to the Coanda effect can be increased, and a particle diameter difference because of a difference between the fuel flows on the upstream side can be reduced. Thus, controllability of penetration of the fuel spray 1018 can be enhanced as a result of the increase of the attracting force, and the atomization of the fuel spray 1018 can be promoted owing to the reduction of a difference between particle diameters of the spray 1018.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A fuel injection valve disposed in an internal combustion engine for injecting fuel radially, the valve comprising:

a valve housing that includes a plurality of fuel nozzle holes arranged in a circumferential direction of the valve housing, wherein:

each of the plurality of fuel nozzle holes includes a fuel inlet and a fuel outlet, and is inclined toward an outer peripheral side in a direction from the fuel inlet to the fuel outlet;

an outer imaginary circle is defined along the circumferential direction of the valve housing;

an inner imaginary circle is defined radially inward of the outer imaginary circle and concentrically with the outer imaginary circle;

the plurality of fuel nozzle holes includes a plurality of outer nozzle holes and a plurality of inner nozzle holes, which are arranged alternately in the circumferential direction of the valve housing;

an opening edge portion of each of the plurality of outer nozzle holes on its fuel outlet-side includes an innermost peripheral edge portion, which is located on the innermost peripheral side of the valve housing and is positioned on the inner imaginary circle;

the outer imaginary circle passes through an outer peripheral side of the innermost peripheral edge portion;

an opening edge portion of each of the plurality of inner nozzle holes on its fuel outlet-side includes an outermost peripheral edge portion, which is located on the outermost peripheral side of the valve housing and is positioned on the outer imaginary circle; and the inner imaginary circle passes through an inner peripheral side of the outermost peripheral edge portion; and a valve member that is accommodated and configured to reciprocate in the valve housing to open or close the plurality of fuel nozzle holes, thereby performing or stopping the fuel injection through the plurality of fuel nozzle holes.

2. The fuel injection valve according to claim 1, wherein the plurality of outer nozzle holes and the plurality of inner nozzle holes are arranged alternately at regular intervals in the circumferential direction, and have a common shape around their hole axes each of which is inclined relative to the central axis of the valve housing on the same longitudinal section as the central axis.

3. The fuel injection valve according to claim 2, wherein the plurality of outer nozzle holes and the plurality of inner nozzle holes have a common inclination angle of their hole axes relative to the central axis.

4. The fuel injection valve according to claim 1, wherein each of the plurality of outer nozzle holes and the plurality of inner nozzle holes has a shape of a tapered hole whose diameter is increased in the direction from the fuel inlet to the fuel outlet as their common shape.

* * * * *